US005571235A

United States Patent [19]

Yano

[11] Patent Number: 5,571,235

[45] Date of Patent: Nov. 5, 1996

[54] DIE ASSEMBLY FOR EXTRUDING HOLLOW ARTICLES

[75] Inventor: Sadahide Yano, Osakashi, Japan

[73] Assignee: Yugen Kaisha Yano Engineering, Osaka, Japan

[21] Appl. No.: 397,037

[22] Filed: Feb. 27, 1995

[51] Int. Cl.[6] ..... B21C 25/04

[52] U.S. Cl. ..... 72/269; 29/447

[58] Field of Search ..... 72/264, 269; 29/447

[56] References Cited

U.S. PATENT DOCUMENTS

| | | | |
|---|---|---|---|
| 4,270,380 | 6/1981 | Gulati et al. | 29/447 |
| 4,368,634 | 1/1983 | Brown et al. | 29/447 |
| 4,697,325 | 10/1987 | Kamigaito et al. | 29/447 |
| 5,061,163 | 10/1991 | Kennedy | 72/269 |
| 5,131,253 | 7/1992 | Hopkins | 72/269 |
| 5,263,352 | 11/1993 | Yano | 72/269 |

FOREIGN PATENT DOCUMENTS

| | | | |
|---|---|---|---|
| 0104412 | 10/1987 | Japan | 72/269 |
| 0557337 | 3/1993 | Japan | 72/269 |

*Primary Examiner*—Lowell A. Larson
*Assistant Examiner*—Ed Tolan
*Attorney, Agent, or Firm*—Armstrong, Westerman, Hattori, McLeland & Naughton

[57] ABSTRACT

A die assembly has at least one core (7), a male die supporter (8) and at least one female member (5). The male die supporter is composed of an annular base (15), a core holder (16) and bridges (17) formed integral with the annular base and the core holder. Each core (7) is shrinkage-fitted in and integral with a cylindrical recess (21) formed in the core holder. The die assembly further has a die retaining mechanism such that the pressure of the material being extruded causes a latchable member to engage with a latching member. Each female member (5) is shrinkage-fitted in and integral with the annular base (15), so that the die assembly can produce hollow articles free from any unevenness in wall thickness, the abraded portion of this assembly can be renewed inexpensively, and the core is surely protected from slipping off.

7 Claims, 23 Drawing Sheets

DIE ASSEMBLY FOR EXTRUDING HOLLOW ARTICLES

BACKGROUND OF THE INVENTION

1. Field of the Invention

The present invention relates to a die assembly for extruding metals, such as aluminum, to produce hollow articles.

2. Related Art Statement

The so-called port-hole dies have widely been used to make aluminum hollow articles, such as a cylindrical pipe.

The port-hole die is an assembly of a male die 101 combined with a female die 102, as shown in FIGS. 23A and 23B. The male die 101 comprises an annular base 103, bridges 104 and a core 105. This core 105, supported by the bridges 104 integral therewith, is located axially of, and protrudes forwardly of, the annular base 103. The female die 102 consists of an annular base 110 and a forming hole 106 extending axially thereof.

The male die 101 has a recessed or protruding periphery 108, and the female die 102 has a protruding or recessed periphery 107 facing the periphery 108 of the male die. Those peripheries fit one in another to align the male die with the female die. Thus, a forming slit 109 is provided between the core 105 and the forming hole 106 aligned therewith.

In such a prior art port-hole die, the annular base 103 and the bridges 104 are integral with the core 105 of the male die 101. Therefore, the male die has to be replaced in its entirety with a new one, when a bearing tip 105*a* of the core 105 has become worn out after a long use in the extrusion process. The replacement of the male die in its entirety has raised the maintenance cost of the die assembly.

It may be possible to use a core supported by the bridges but separable from the remaining parts of the male die. In this case, a core holder may be formed integral with the bridges so that the core can solely be removed from the male die when the bearing tip of said core is abraded. The parts, except for the core, can thus be reused to remarkably lower the maintenance cost of die change.

However, in case of using the core supported by and separable from the core holder, it will be difficult for the core to be precisely placed in the holder. Thus, accurate alignment of the separable core with the forming hole will not be ensured, thereby causing a problem that uneven wall thickness, which impairs the dimensional precision of extruded hollow articles, can result.

The prior art port-hole die shown in FIGS. 23A and 23B suffers another problem resulting from its structure in which the position of core 105 relative to the forming hole 106 is regulated by the annular recess 108 mating with the annular protrusion 107. Such recesses and protrusions are formed along the peripheries of the bases 103 and 110, and are thus remote from the forming slit 109. An uneven deformation is likely to occur in the male or female die, due to the extruding pressure imparted to the rear face of the die assembly. Such an uneven deformation will disturb the alignment of said core 105 with the hole 106, whereby the wall thickness of each extruded article would become uneven in the circumferential direction.

It is important, at first, to surely protect the separable core from slipping off. The core must easily be mounted in the die assembly, without needing much labor. Further, the die assembly, including the separable core, should be manufactured easily and inexpensively. However, the previously proposed structures for holding the separable core do not necessarily meet all of these requirements.

OBJECTS OF THE INVENTION

An object of the present invention made in view of those problems in the prior art is, therefore, to provide a die assembly for extruding hollow articles such that the die change can be done inexpensively when its parts are worn out, and such that the extruded articles produced thereby are free from any uneven thickness of their walls.

Another object is to provide a die assembly adapted for extruding hollow articles and comprising a separable core which can be held exactly in place and well not slip off during the extrusion process, can easily be mounted in the die, and can be manufactured inexpensively.

Other objects and advantages of the present invention will become apparent from some embodiments thereof, that will be described below merely to exemplify the invention but not to restrict the scope thereof. Those embodiments can of course be modified within the spirit of the present invention.

SUMMARY OF THE INVENTION

The present invention provides, to achieve these objects, a novel die assembly that comprises at least one core having a bearing tip to form a hollow space through a hollow article extruded by the die assembly, at least one male die supporter composed of an annular base, a core holder and bridges rigidly connecting the base to the core holder, a cylindrical recess formed in the core holder so as to open forward in the direction of extrusion, at least one female member having a bearing hole to form a periphery of the hollow article, and a core retaining means to prevent the core from slipping off forward in the direction of extrusion, wherein a body of the core is shrinkage-fitted in the cylindrical recess of the core holder so as to be integral with the die supporter, and the female member is shrinkage-fitted in the annular base of the die supporter so as to be integral therewith. The female member is of a significantly smaller size than the prior art female die.

The core retaining means may preferably comprise a cylindrical lug protruding forward in the direction of extrusion beyond the bridges, slits formed in the cylindrical lug and longitudinally thereof so that sections each defined between the adjacent slits can reversibly deform itself radially and inwardly of the lug, and a latching mechanism including of a protrusion formed integral with an inner periphery of the cylindrical lug and a recess formed integral with an outer periphery of the core, such that a pressure of a material being extruded acts on an outer periphery of the lug so that the protrusion thereof is forced radially and inwardly to engage with the recess of the core, thereby preventing the core from slipping off in the direction of extrusion. It will be understood that the protrusion from the cylindrical lug may be replaced with a recess, and the recess formed in the core may correspondingly be replaced with a protrusion.

Preferably, the recess of the core may be an annular groove engageable with the protrusion which is also annular and jutting from the inner and foremost peripheral edge of the cylindrical lug.

The bore may preferably penetrate the core holder in the direction of extrusion such that a radial shoulder is formed perpendicular to said direction and intermediate the front and rear ends of said bore. The shoulder supports the rear end of the core, and a larger-diameter region formed between the shoulder and the front end of the bore receives the body portion of said core. A smaller-diameter region is formed between the shoulder and the rear end of the bore, such that a portion of the rear end surface of the core is exposed to said smaller-diameter region. The exposed surface may be struck with a punch or the like, as will be detailed below.

From another aspect, the present invention provides a die assembly comprising a core having a bearing tip to form a hollow space through a hollow article extruded by the die assembly, a core holder integral with bridges and having a cylindrical recess formed in the core holder so as to open forward in the direction of extrusion, a cylindrical lug protruding forward in said direction beyond the bridges, slits formed in the cylindrical lug and longitudinally thereof so that sections each defined between the adjacent slits can reversibly deform itself radially and inwardly of the lug, and a core retaining means consisting of a protrusion or recess formed integral with or in an inner periphery of the cylindrical lug and a recess or protrusion formed in or integral with an outer periphery of the core, such that a pressure of a material being extruded acts on an outer periphery of the lug so that the protrusion or recess thereof is forced radially and inwardly to engage with the recess or protrusion of the core, thereby preventing the core from slipping off in the direction of extrusion.

BRIEF DESCRIPTION OF THE DRAWINGS

FIG. 68 is a side elevation of a male die holding block also included in the die assembly and seen from the line 2—2 in FIG. 1;

THE PREFERRED EMBODIMENTS

Figure 1:
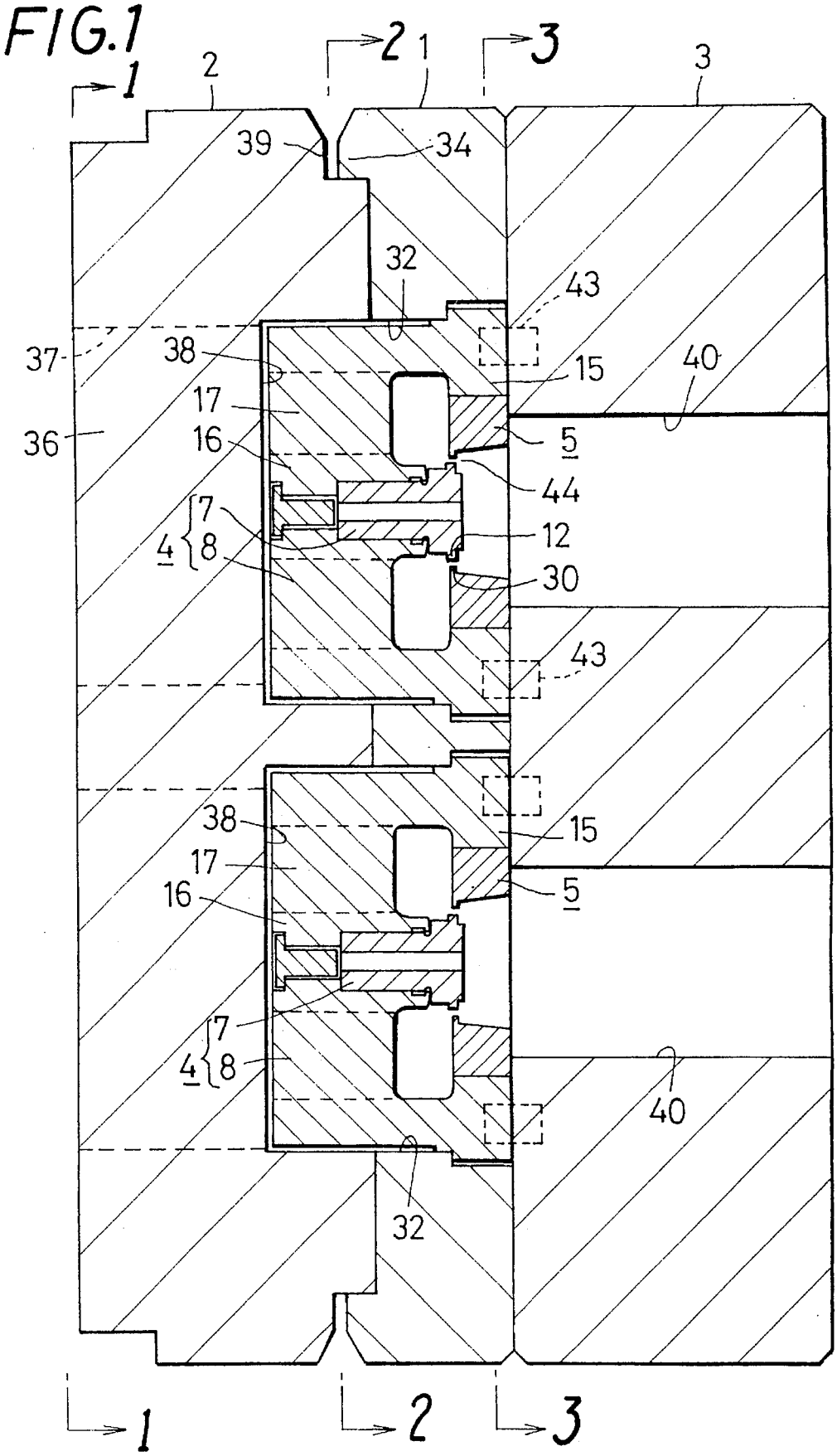
FIG. 1 is a cross section of a die assembly shown in its entirety and provided in a first embodiment.

Now, some preferable embodiments of the present invention will be described.

In the described embodiments, each die assembly is such that a plurality of hollow articles are extruded concurrently, and the hollow articles are round aluminum pipes. However, it will be understood that each die assembly may be constructed to extrude a single hollow article that may not be a round aluminum pipe but any other metallic pipe of any desired cross-sectional shape.

FIGS. 1–8 show a die assembly provided in a first embodiment, in which the reference numeral 1 denotes a male die holding block. The numerals 2 and 3 respectively denote a flow regulating block and a back-up block. The further reference numerals 4 and 5 denote male dies and female members, respectively. Each of the female members 5 is of a size significantly smaller than the prior art female die.

Each male die 4 comprises a core 7 and a die supporter 8.

The core is made of a hard material such as a hard metal (viz. cemented carbide) or ceramics. As shown for example in FIG. 2, an annular shoulder 9 is formed around the core. This shoulder is located intermediate the front and rear ends of the core, but closer to the front end thereof. The shoulder 9 faces the rear end of the core. A frontal larger-diameter portion of said core 9 is located ahead the shoulder so as to serve as a forming head 10. A rearward smaller-diameter portion 11 of the core 9 is a body portion thereof to engage with the die supporter. A bearing tip 12 is formed around the forming head 10 so as to define a hollow longitudinal space through the extruded article. An annular groove 13 is formed around the smaller-diameter portion 11, and proximate the shoulder 9. An axial bore 14 penetrates the core 7.

Figure 3:
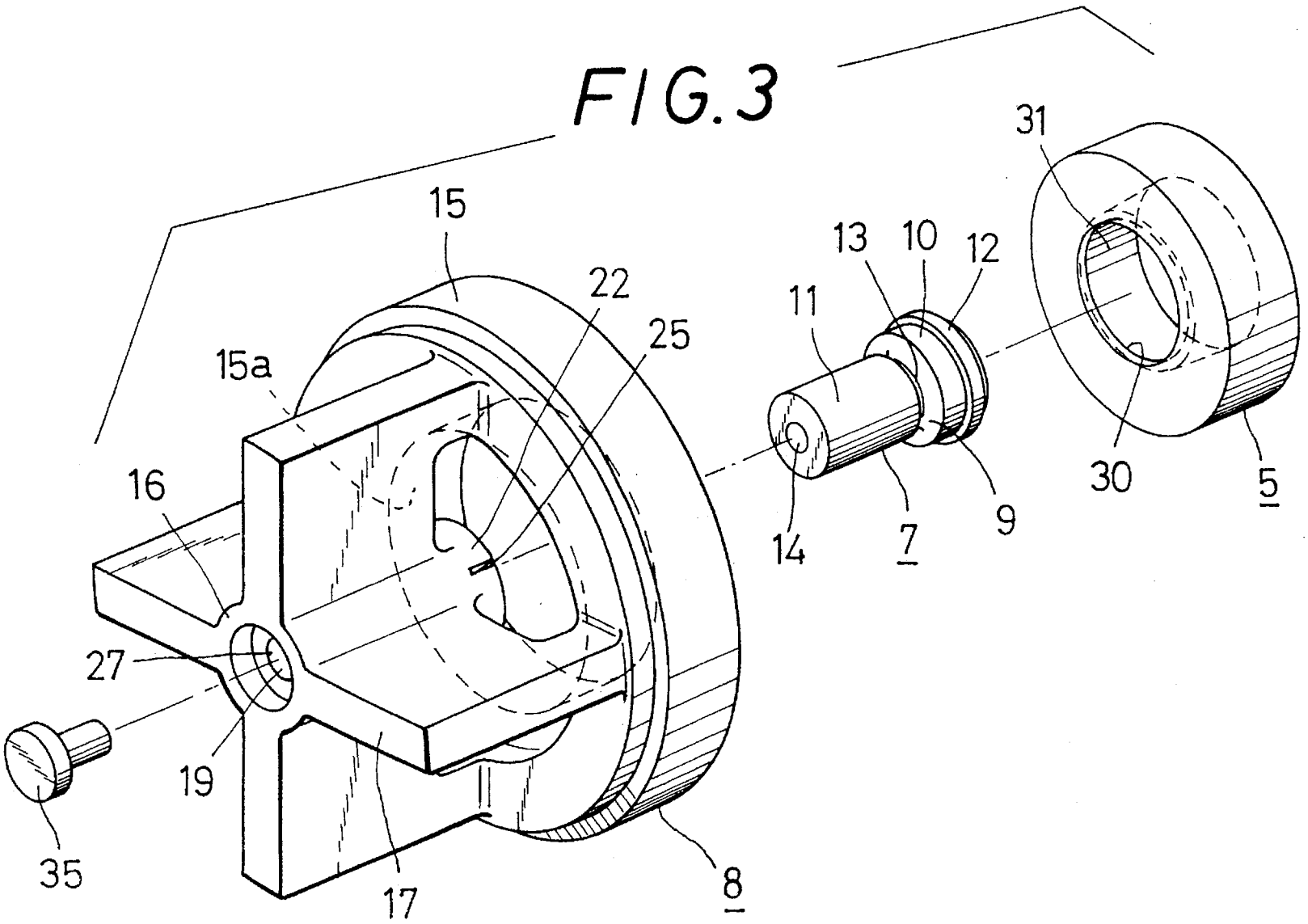
FIG. 3 is a perspective view of a die supporter, a core, a female member and another member included in the die assembly and separated one from another.

The die supporter 8 is made of a steel, such as a die steel. As shown in FIG. 3, etc., the die supporter is composed of an annular base 15, a core holder 16 and bridges 17 integral with the base and the holder.

Figure 2:
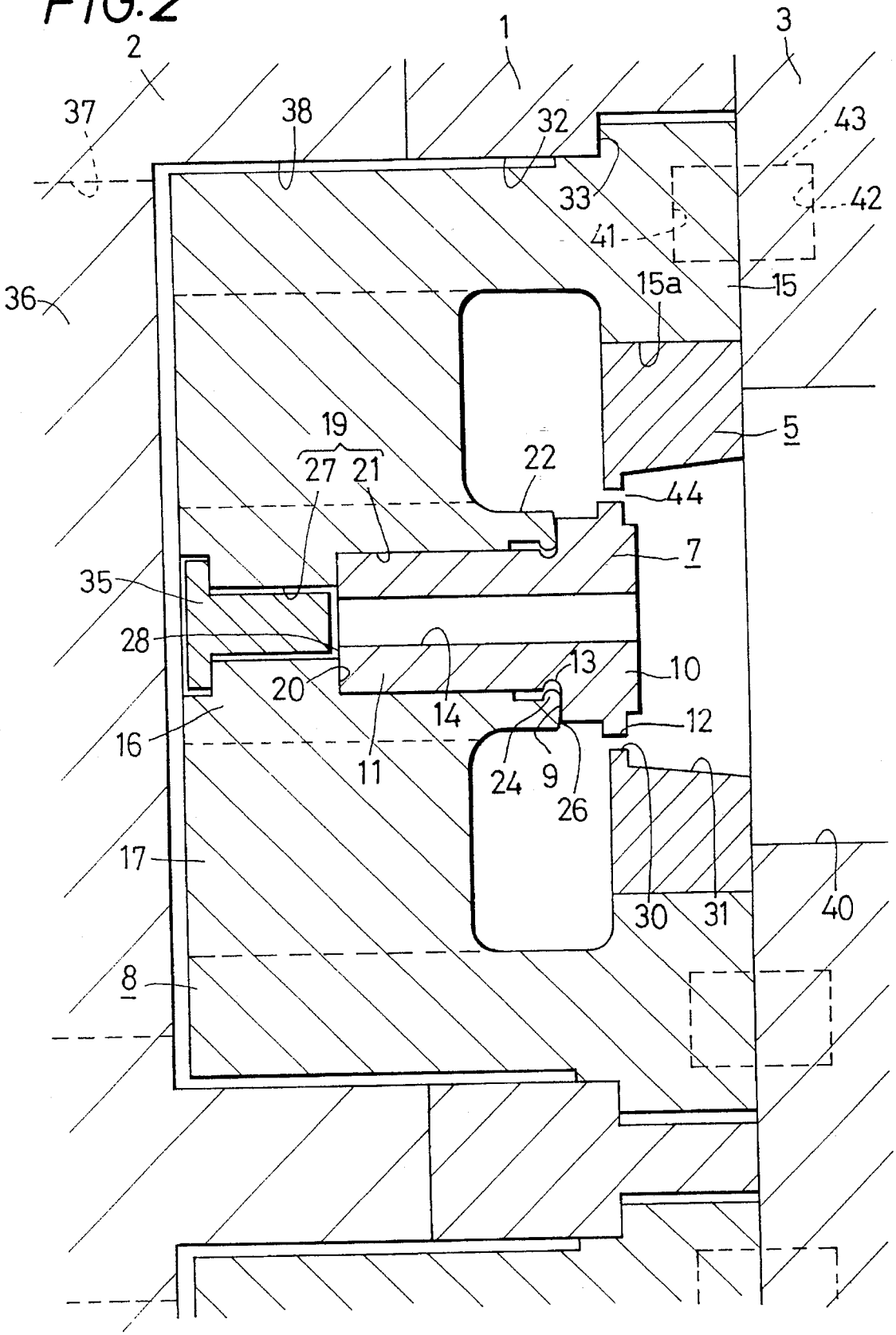
FIG. 2 is an enlarged cross section of a main part of the die assembly.
Figure 4:
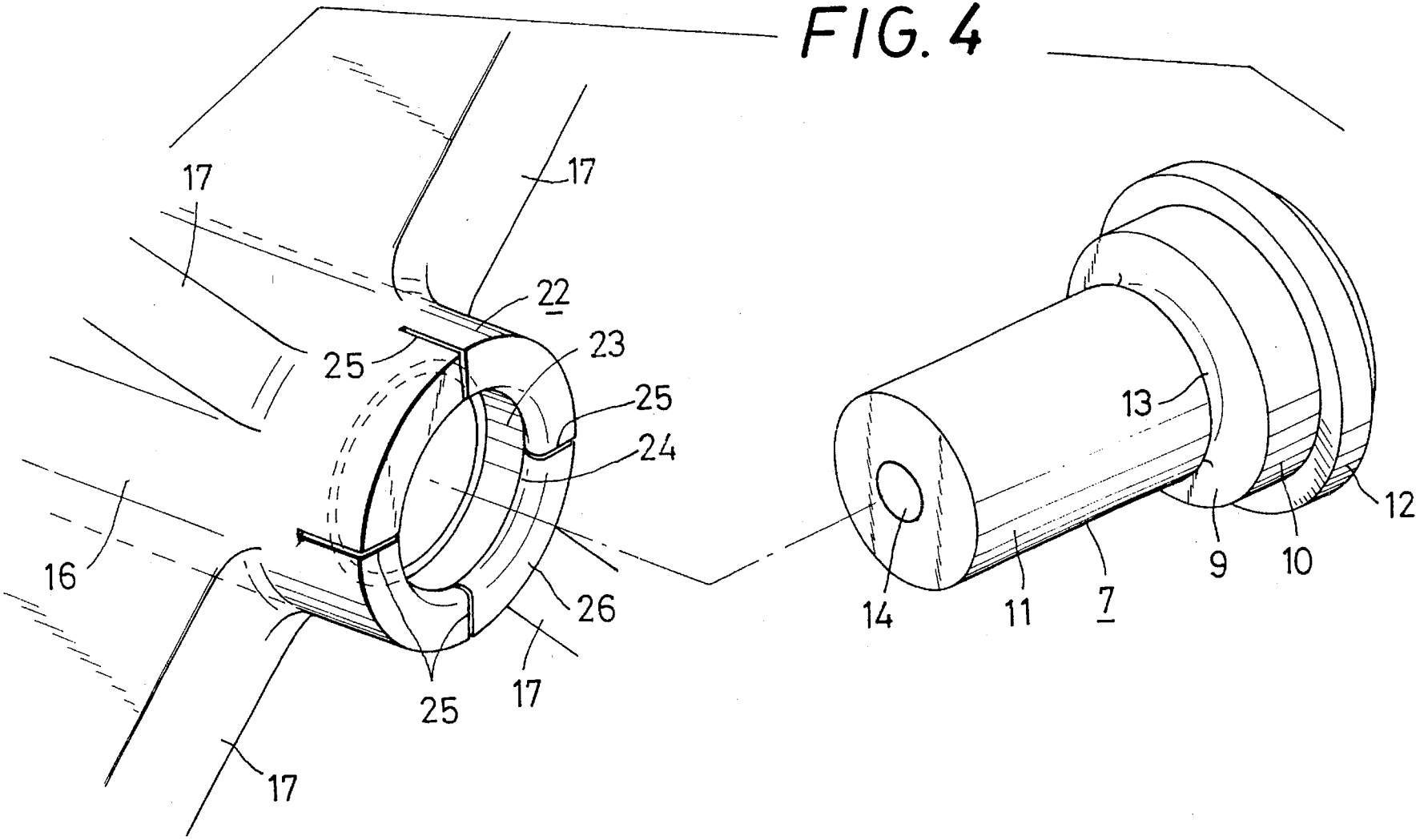
FIG. 4 is a perspective view of the core removed from a cylindrical lug which is formed integral with and as a portion of the die supporter.

The bridges 17 jut from the annular base 15, rearwardly in the sense of the direction in which aluminum is extruded. The bridges as a whole assume a cruciform in cross section and span diagonal portions of the annular base. The core holder 16 is formed integral and coaxially with a crossing region of the bridges 17. As shown in FIGS. 2–4, a front end of the core holder 16 is disposed rearwardly of the annular base 15, but forwardly of the crossing bridges 17, with respect to the direction of extrusion.

FIG. 2 shows that the core holder 16 has an axial bore 19. An annular shoulder 20 facing the front end is formed at an intermediate region of and around the axial bore. A cylindrical recess 21 provided as a forward and larger-diameter region of the bore is adapted to fit on the body 11 of the core 7.

The annular shoulder 20 bears against a rear end of the core 7 so that a circular bearing tip 12 thereof takes a correct position facing a rear edge of the annular base 15.

The peripheral wall surrounding the cylindrical recess 21 in the core holder 16 juts ahead to provide a cylindrical lug 22. This lug 22 thus protrudes forwardly of the crossing bridges 17.

Figure 5:
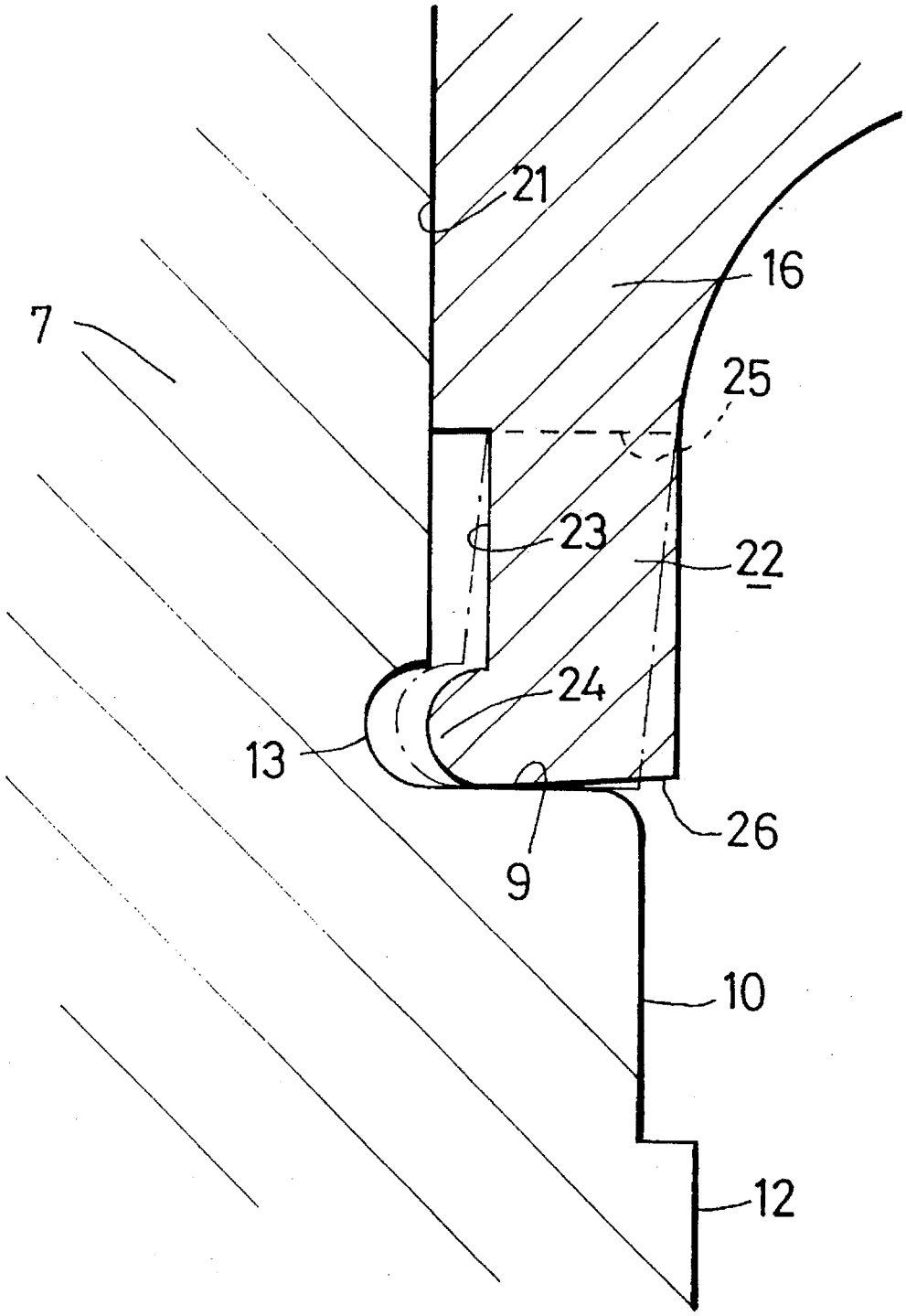
FIG. 5 is an enlarged and partial cross section of the core and the cylindrical lug which is engaging with said core, due to a latching mechanism.

FIGS. 4 and 5 show that an annular flat recess 23 of a proper width is formed in the inner periphery of the cylindrical lug 22, terminating short of the forward extremity thereof. An inner portion of this forward extremity serves as an annular protrusion 24 engageable with the annular groove 13 formed in the core.

Formed in and longitudinally of the cylindrical lug 22 are a plurality of, for example four, slits 25 located at regular angular intervals. The pressure of a material being extruded will force the forward end region of said lug to elastically deform centripetally. Thus, the annular protrusion 24 will be displaced inwardly towards the core.

As best seen in FIG. 5, a front end face 26 of the cylindrical lug 22 is in close contact with the annular shoulder 9 of core 7 held by the die supporter. There is a possibility that the end face 26 will catch the surface of said shoulder 9, when making the centripetal deformation. Therefore, said end face 26 is slightly tapered outwardly and rearwardly.

Figure 8:
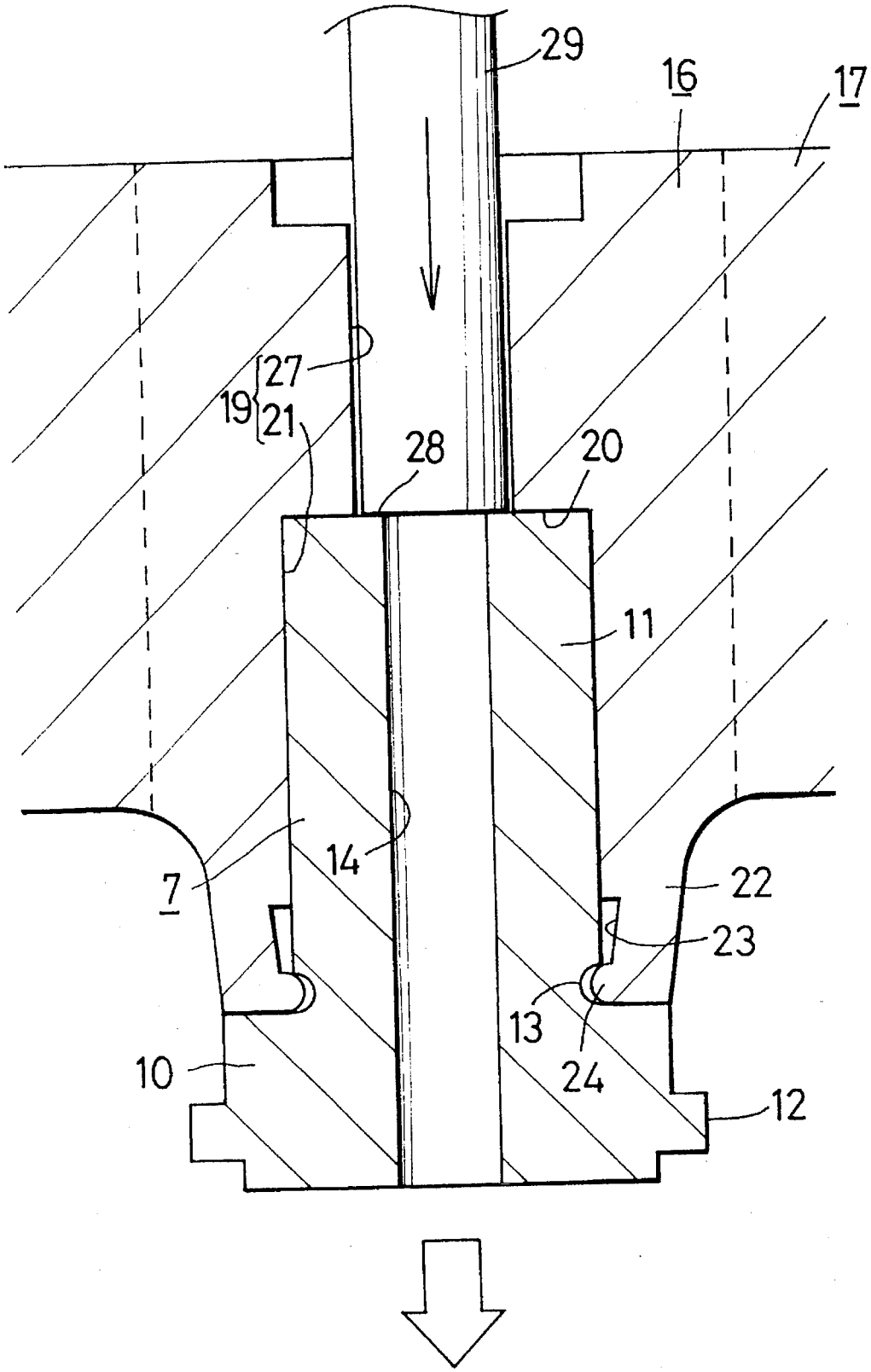
FIG. 8 shows a manner of dismounting the core from the male die.

FIGS. 2 and 8 show that the axial bore 19 through the core holder 16 is reduced in its diameter behind the annular shoulder 20, so as to provide a smaller-diameter tool-insertion hole 27. This hole is however of a diameter larger than that of the axial bore 14 of core 7. The rear end face of the core thus has an inner circular area 28 accessible through the hole 27, so that a punch, or the like, tool 29 can strike said area 28 and push the core out of the axial bore 19.

Each female member 5 is a short columnar piece made of a hard material such as a hard metal or ceramics, as shown in FIGS. 2 and 3. The female member is of the same height as the annular base 15 of the die supporter 8. The female member 5 has an outer diameter such that it tightly fits in said annular base. Formed centrally of and integral with a rear end of this female member is an annular bearing edge 30 facing the circular bearing tip. This bearing edge 30 for defining an outer periphery of the extruded article continues to a relief hole 31 of a diameter increasing towards the front face of said member 5.

The reference numeral 35 denotes a plug inserted forwardly from the rear opening of the tool-insertion hole 27 in the core holder 16, which holder is the integral part of the die supporter 8. The plug 35 prevents the material being extruded from entering the axial bore 19 during extrusion.

Figure 6A:
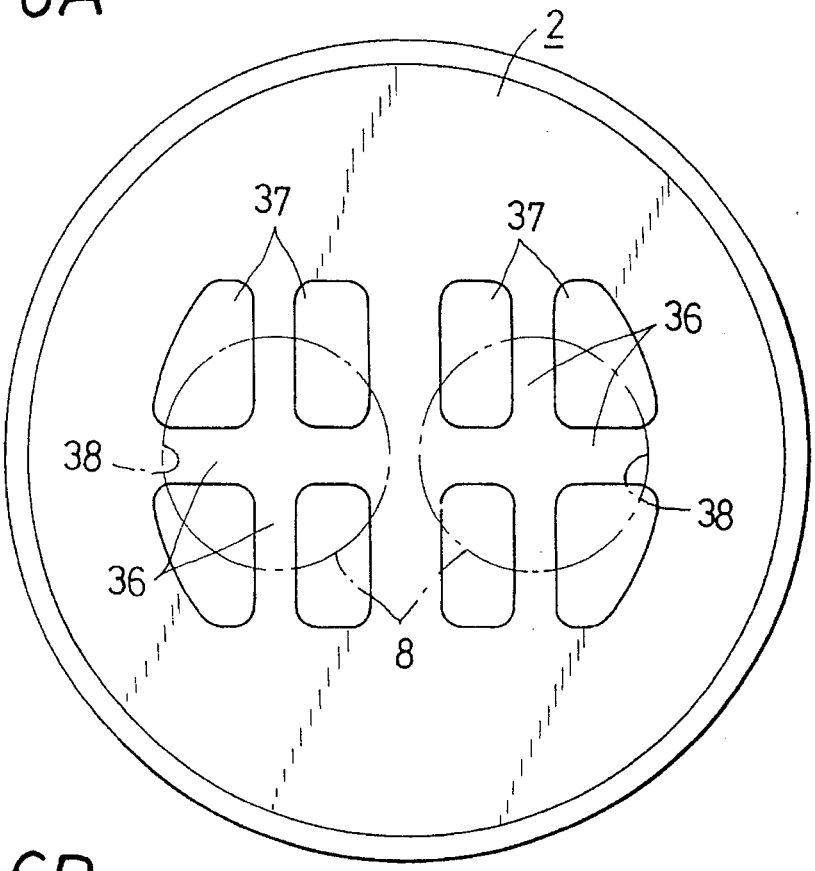
FIG. 6A is a side elevation of a flow regulating block included in the die assembly and seen from the line 1—1 in FIG. 1.
Figure 6B:
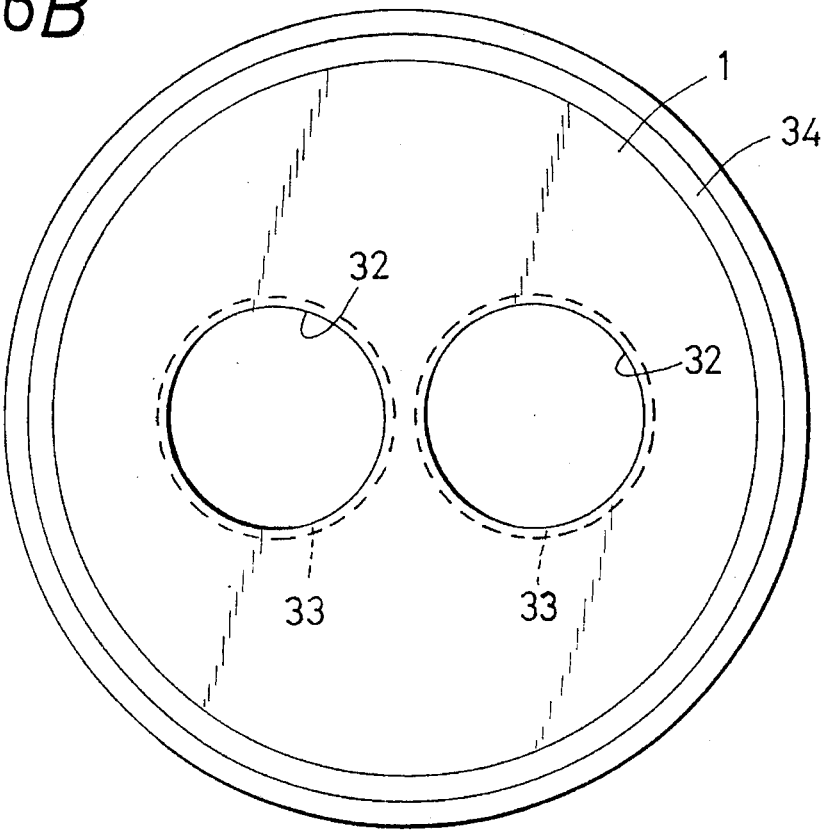

The aforementioned male die holding block 1 holds two couples of the die supporter and the female member, as seen in FIGS. 1, 2 and 6B. This block 1 is a large disc made of a steel, such as a die steel, and has two through-holes 32 and 32 corresponding to said couples. These through-holes penetrating the block 1 are arranged side by side. An annular shoulder 33 is formed in each through-hole, intermediate the front and rear faces of said block 1, and facing the front. The rear circular edge face of the annular base 15 as the part of each die supporter 8 tightly rests on the annular shoulder 33 so as to provide an anti-leakage seal between them. In this state of the annular base 15, the front face thereof is flush with the front face of the male die holding block 1. The bridges 17 of said supporter 8 jut rearward from the block 1. An annular protrusion 34 formed rearward from the rear annular portion of the male die holding block renders it to be coaxially aligned with the flow regulating block 2.

The flow regulating block 2 is a large disc made of a steel, such as a die steel, and receives and regulates the material flow which will be charged from a container or the like, so as to be extruded. As shown in FIG. 6A, two groups of four discrete apertures 37 are defined each between two adjacent bridges 36. These bridges 36 are arranged to correspond to the respective bridges 17 of each die supporter 8. Two cavities 38 formed in the front face of the flow regulating block 2 are located, corresponding to the die supporters 8. With the flow regulating block 2 being fixed to the rear face of the male die holding block 1, the bridges 17 of each die supporter held in the cavity 38 will take their position close to but not contacting said flow regulating block.

An annular cutout 39 formed around the frontal circular edge of the flow regulating block 2 is engageable with the annular protrusion 34 of the male die holding block 1. Thus, those blocks 1 and 2 can easily and accurately be aligned with each other.

Figure 7:
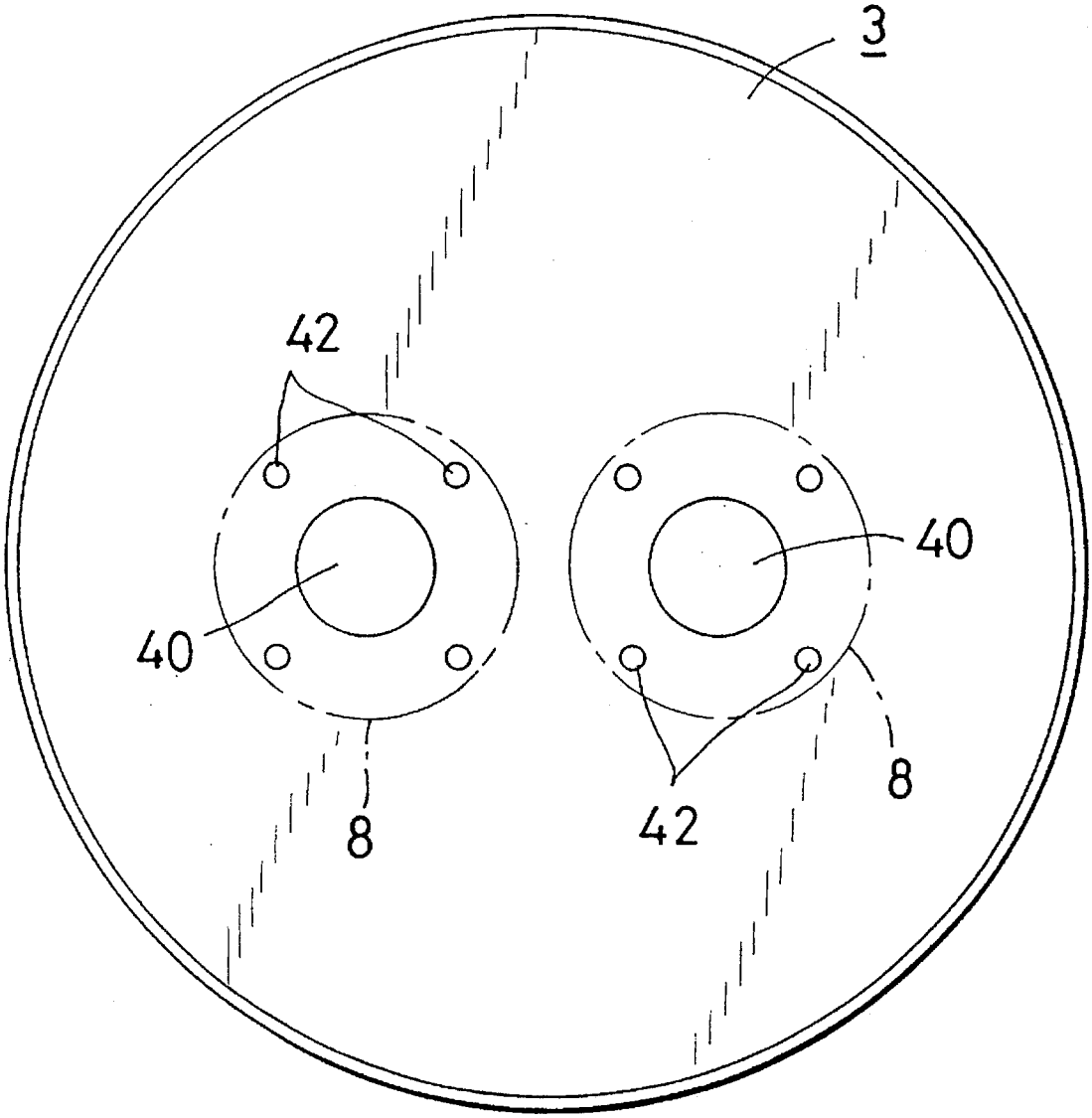
FIG. 7 is similarly a side elevation of a back-up block included in the die assembly and seen from the line 3—3 in FIG. 1.

The back-up block 3 is also made of a steel, such as a die steel. Relief holes 40 of a diameter somewhat smaller than the outer diameter of the female member 5 are formed through the back-up block. Each relief hole 40 extends coaxially with a forming slit 44. When secured to the front face of the male die holding block 1, the back-up block 3 will support the front faces of each die supporter 8 and each female member 5, while allowing each extruded hollow article to advance freely through the relief hole 40. FIGS. 1, 2 and 7 show that pin holes 41 in the annular base 15 and around each relief hole 40 are aligned with respective pin holes 42 formed in the back-up block. Tie-pins 43 each fitting in the facing pin holes 41 and 42 are thus effective to arrange each annular base 15 of the male die supporter 8 at correct position relative to the back-up block 3.

The parts describe above will be combined with each other in the following manner to provide the die assembly. The body 11 of the core 7 will at first be put rearward into the cylindrical recess 21 of the core holder 16 formed as one portion of the die supporter 8, so that the rear face of said core bears against the annular shoulder 20. The female member 5 will be placed tightly in the annular base 15 as the other portion of said supporter 8, such that the annular bearing edge 30 of the female member 5 takes a rear position relative thereto. (Subsequently, the core 7 and the female member 5 will be shrinkage-fitted in the die supporter 8.) Thus, the bearing tip 12 of the core 7 will be located inside the bearing edge 30, whereby the forming slit 44 appears between said tip 12 and said edge 30 and rearwardly of the annular base 15. Another trio of the supporter, the core and the female member will further assembled in the same manner. Two trios of those parts are then placed in the through-holes 32 of the male die holding block 1, which will subsequently be combined with the flow regulating block 2 and the back-up block 3.

In use, the die assembly prepared in this manner will be attached to a front face of a container, or the like, included in an extrusion apparatus. A stem will be driven to force an aluminum billet out of the container and through the die assembly. During the extrusion, the bridges 17 will cause the aluminum billet to flow in the shape of tributaries. Those tributaries will then meet one another to flow along an outer periphery of the cylindrical lug 22 of the supporter 8, before leaving this die assembly through the forming slit 44 to form a round pipe.

In operation of the die assembly during extrusion, the pressure of aluminum streams will act on the cylindrical lug 22. The slits 25 formed in said lug will permit same to deform radially and inwardly. Thus, the annular protrusion 24 of the lug 22 engages with the annular groove 13 of the core 7, and consequently the core is held in place within the core holder 16 formed as the portion of supporter 8.

If and when the circular bearing tip 12 of the core 7 will have been abraded after a considerable period of operation, then the core will be renewed. At first, the die supporter 8 will be removed from the male die holding block 1. Then, a punch or the like tool will be inserted rearward into the axial bore 14 through the core so as to take the plug 35 out of this bore. Next, a larger punch, or the like, 29 will be inserted forwards into the tool-insertion hole 27 of said bore in order to strike the rear face 28 of the core. The core 7 will thus be ejected forwards, as will be seen in FIG. 8.

The male die 4 in the described embodiment consists of the core 7 and the supporter 8. When the male die is abraded and has to be renewed, only the core need be replaced with a new one, reusing the supporter to lower the maintenance cost. Manufacture cost is also reduced because only the core 7 having the bearing tip 12 need be made of such an expensive hard metal that can lengthen the life of said core.

Since the core 7 is shrinkage-fitted in the cylindrical recess 21 of supporter 8, the core holder 16 can exactly hold the core and enhance accuracy in alignment thereof with the bearing edge 30. Consequently, high quality hollow articles free of any uneven wall thickness are now produced.

Since the female member 5 tightly fits in the annular base 15 of the die supporter 8, the position of said core relative to the bearing edge 30 is regulated by the base's inner periphery located near the forming slit 44. Thanks to this feature, any forward pressure imparted to, and tending to deform, the parts of this die assembly will not cause any intolerable displacement of the core 7 relative to said edge 30. Thus, the extruded hollow articles are protected from unevenness in their wall thickness.

Further, the female member 5 is shrinkage-fitted to the inner periphery 15*a* of the supporter's annular base 15 so that a high accuracy is ensured to the alignment thereof with said member 5 and thus to the alignment of the bearing edge 30 with the core 7. Therefore, the extruded hollow articles are free from unevenness in their wall thickness.

As described above, the annular base 15 having the inner periphery 15*a* fitting on the female member 5 is integral with the bridges 17 and with the core holder 16 having the cylindrical recess 21 for holding the core 7. Therefore, the core 7 is precisely aligned with the female member 5, also avoiding any uneven wall thickness in extruded articles.

Particularly in a case wherein the forming slits 44 are arranged offset with respect to the center of die assembly adapted for simultaneously extruding a plurality of hollow articles, there has been the likelihood that an irregular deformation of the parts in the prior art die assembly to produce low quality extrudates. However, the die assembly proposed herein does not bring about such a problem, because each bearing edge 30 is always kept at correct position relative to the corresponding core 7.

The retaining mechanism for preventing the core from slipping off utilizes the annular protrusion 24 jutting from the cylindrical lug 22. With this lug being deformed centripetally by the extrusion pressure, said protrusion 24 will be forced into engagement with the annular groove 13 formed in the core 7. Thus, the core is surely protected from being unintentionally removed from the die assembly.

Such a retaining mechanism enables a simpler and easier assembling of the die, since the core 7 need be simply put in the cylindrical recess 21 of the core holder 16 in order attach said core to the die supporter 8.

The retaining mechanism for the core can be manufactured easily and inexpensively by forming the slits 25 in the peripheral wall of cylindrical lug 22 and by forming the annular groove 13 in the core together with the protrusion 24 on the inner periphery of said lug.

It is advantageous that such a protrusion 24 can be provided by simply forming the flat annular groove 23 in the inner peripheral surface cylindrical lug 22.

Engagement of annular protrusion 24 with annular recess 13 affords a very reliable connection of the core to the core holder.

The annular shoulder 20 facing the front end and disposed between the large diameter cylindrical recess 21 and small diameter tool-insertion hole 27 of the axial bore 19 is useful to support and position the rear face of the core 7 being mounted on the die assembly. The plug 35 covering the rear face will be removed from the hole 27 so that the punch, or the like tool 29 is inserted in this hole so as to strike forwards and readily remove the core 7 out of the axial bore.

It is also advantageous that each female member 5 secured in the annular base 15 of the die supporter 8 serves as a female die of a size significantly smaller than prior art female dies. This is because the female member for providing at its rear end flush with or close to the rear edge of annular base 15 the forming slit 44 has a smaller surface area in contact with the material which is being extruded, thereby reducing the extrusion pressure to overcome the friction inevitable between the material and the female member.

Figure 9:
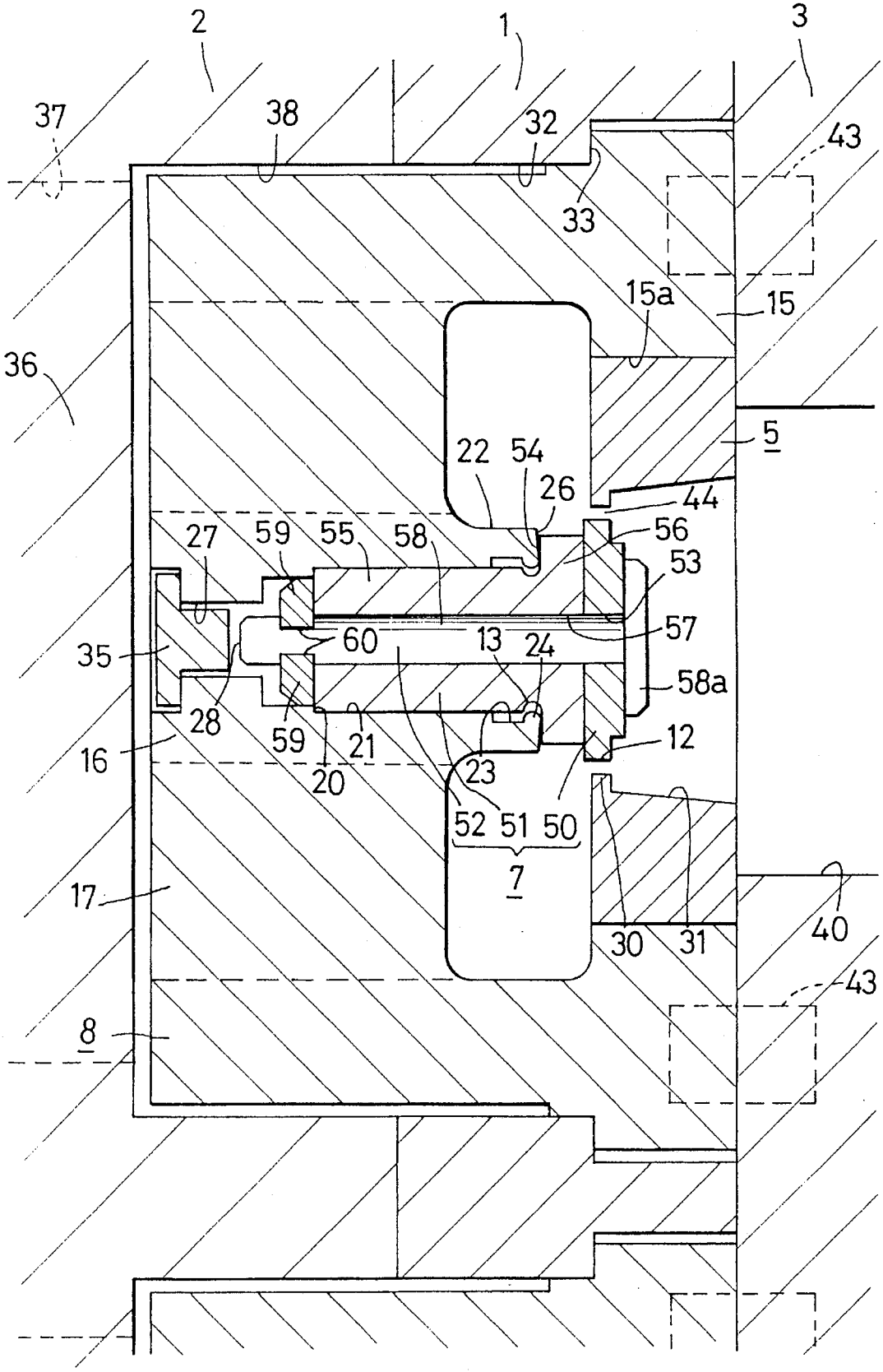
FIG. 9 is an enlarged cross section of a main part constituting a die assembly provided in a second embodiment.
Figure 10:
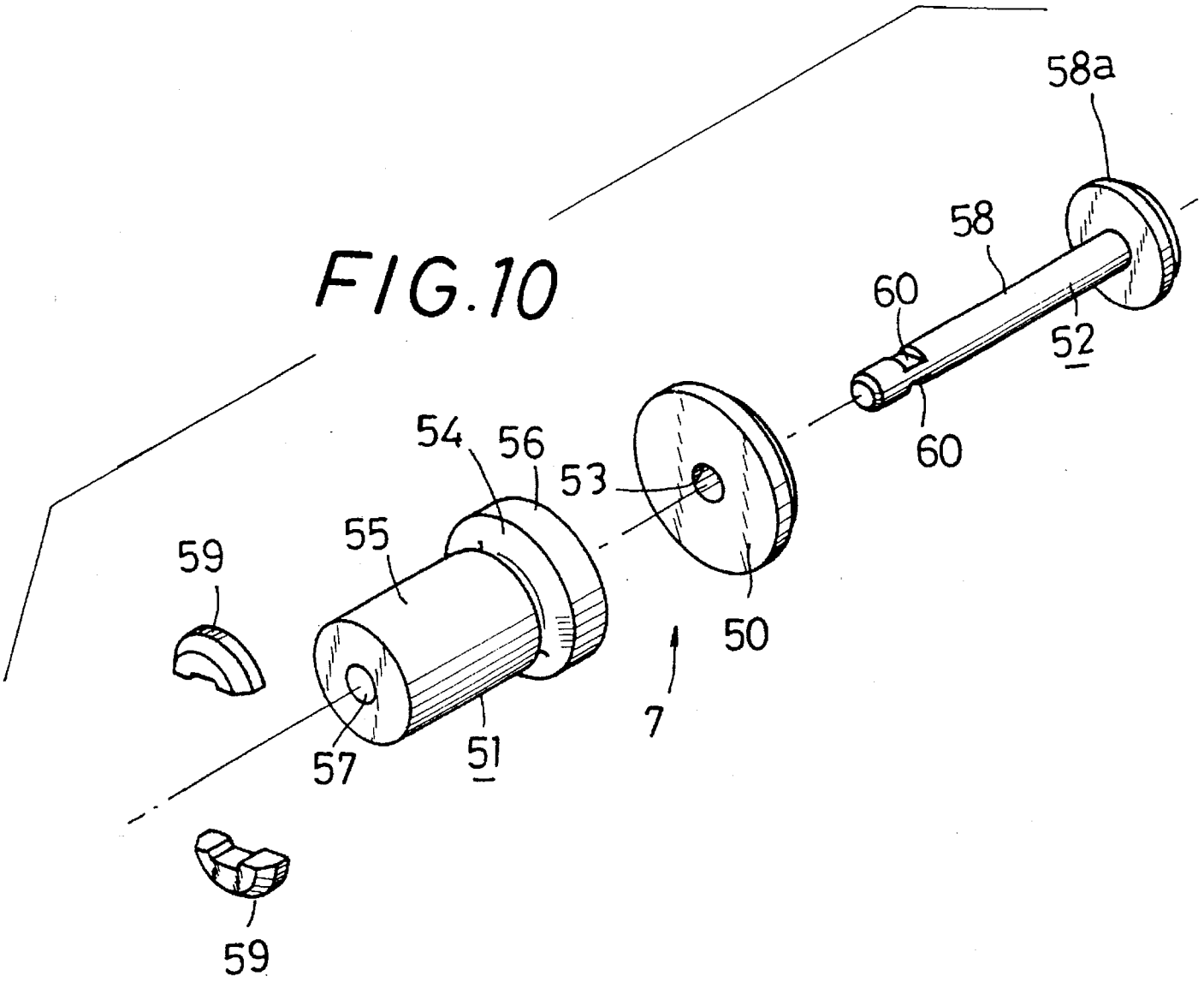
FIG. 10 is a perspective view of a core, whose parts are shown in a disassembled state, in the second embodiment.
Figure 11:
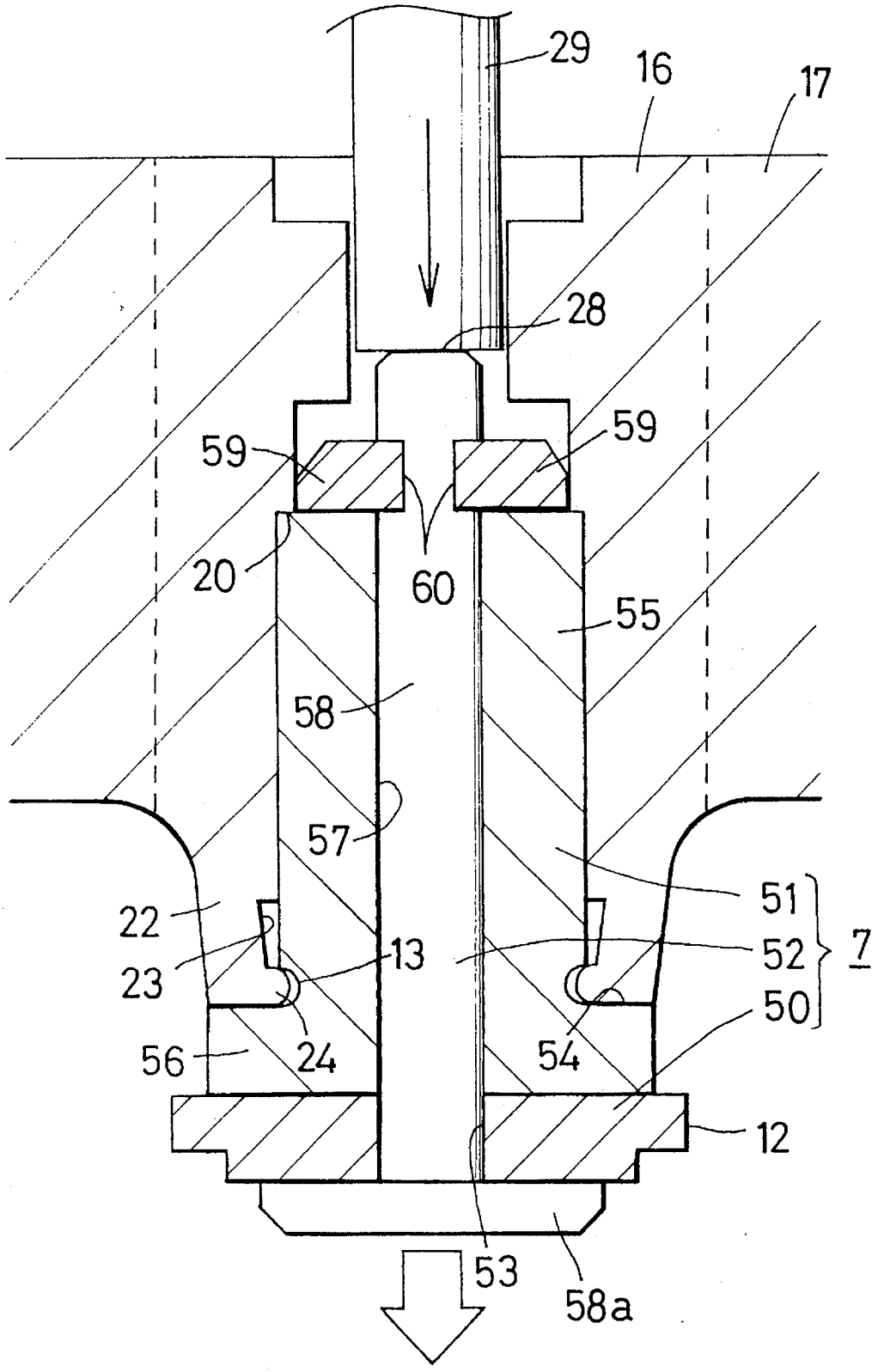
FIG. 11 shows a manner of dismounting the core from the male die, in the second embodiment.

In a second embodiment shown in FIGS. 9–11, the core 7 is of a composite structure. This core comprises a bearing male member 50, a holder 51 for holding this member, and a connecting rod 52 for securing the bearing male member 50 to the holder 51. All the members 50–52 constituting a male die are made of a hard material, such as a hard metal.

The bearing male member 50 is a disc whose thickness is equal to, or somewhat greater than, the bearing length, and the disc has a bore 53.

The holder 51 has an annular shoulder 54. This shoulder is disposed at a location intermediate the front and rear ends of said holder, and faces the rear end. A rear body 55 of said holder is of a diameter smaller than a front head 56. This head supports the bearing male member 50. An axial bore 57 formed through the holder is of the same diameter as the bore 53 of the male member 51.

The connecting rod 52 has a stem-shaped body 58 and a plate-shaped head 58*a*, and this head and the head 56 of the holder 51 grip therebetween the male member 50. The body 58 fits in the two bores 53 and 57 so as to align the male member 50 with the holder 51. A pair of transverse recesses 60 are formed in a rearwardly protruding end portion of the body 58, at angular intervals of 180 degrees.

The stem-shaped body 58 will be inserted in the bores 53 and 57 so that the male member 50 is held between the heads 56 and 58*a* in order to secure this male member 50 to the holder 51. A pairs of keys 59 will be fitted in the transverse recesses 60, such that outer portions of said keys are supported by the rear face of the holder 51. The bearing male member 50, thus gripped between the holder and the head 58*a*, provides a principal part of the core 7. This core will then be fitted in the cylindrical recess 21 of the core holder 16 formed as one portion of the die supporter 8. The outer peripheral surface of each key 59 bears against the inner periphery of the cylindrical recess 21 so as not to slip off. Also in this case, the body 55 of the holder 51 is shrinkage-fitted to the core holder 16.

When the bearing tip 12 has been abraded and must be renewed, only the bearing male member 50 as the separable element of the core 7 need be replaced with a new one, thus further lowering the maintenance cost of this die assembly.

The core 7 will be struck at its rear face by the punch, or the like, tool 29 after removing the plug 35, as seen in FIG. 11. The bearing portion of the female member 5 may also be a separable element thereof having a thickness substantially equal to the bearing length, though not shown in the drawings. The other structural features of the second embodiment are the same as those employed in the first embodiment.

Figure 12:
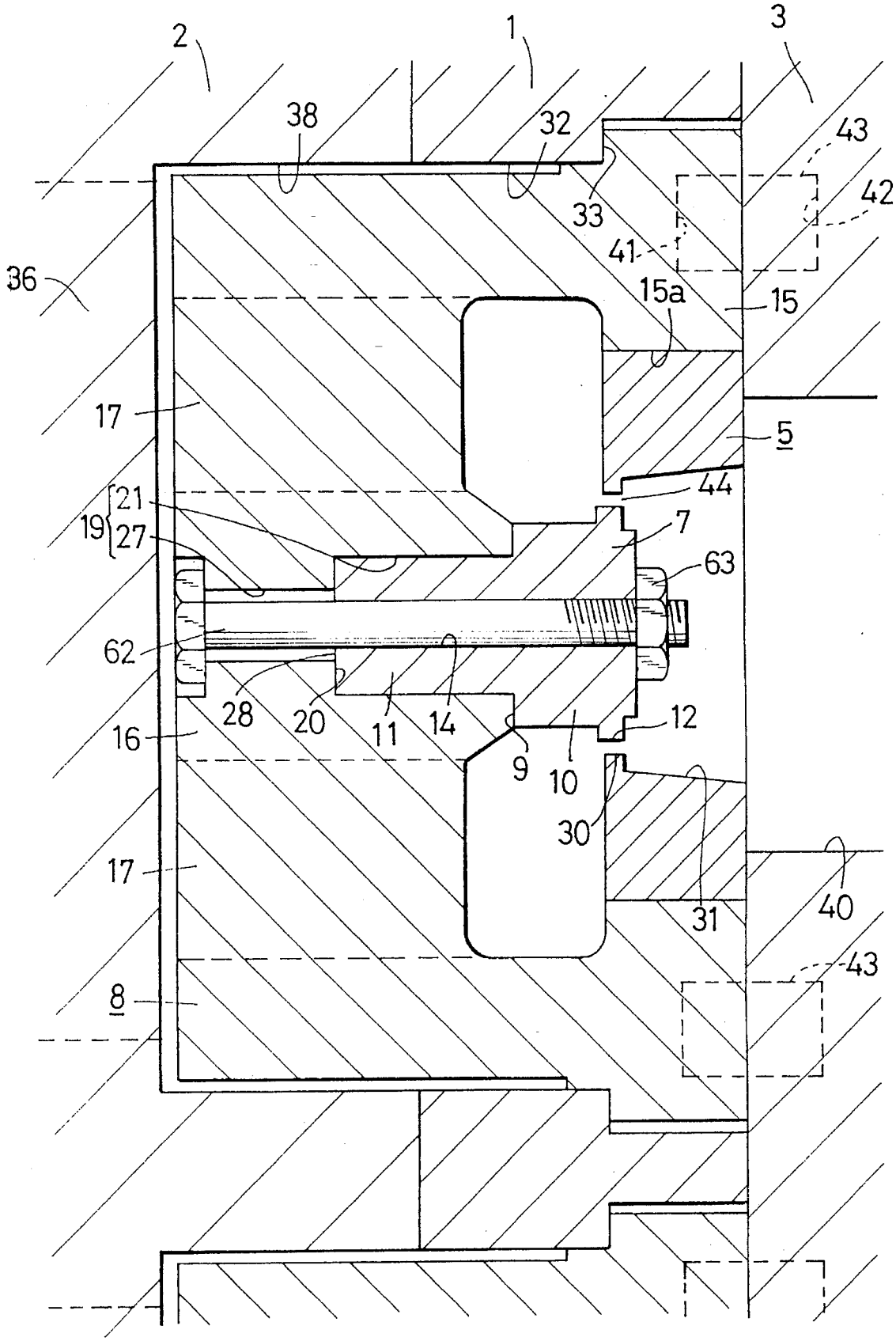
FIG. 12 is an enlarged cross section of a main part constituting a die assembly provided in a third embodiment.
Figure 13:
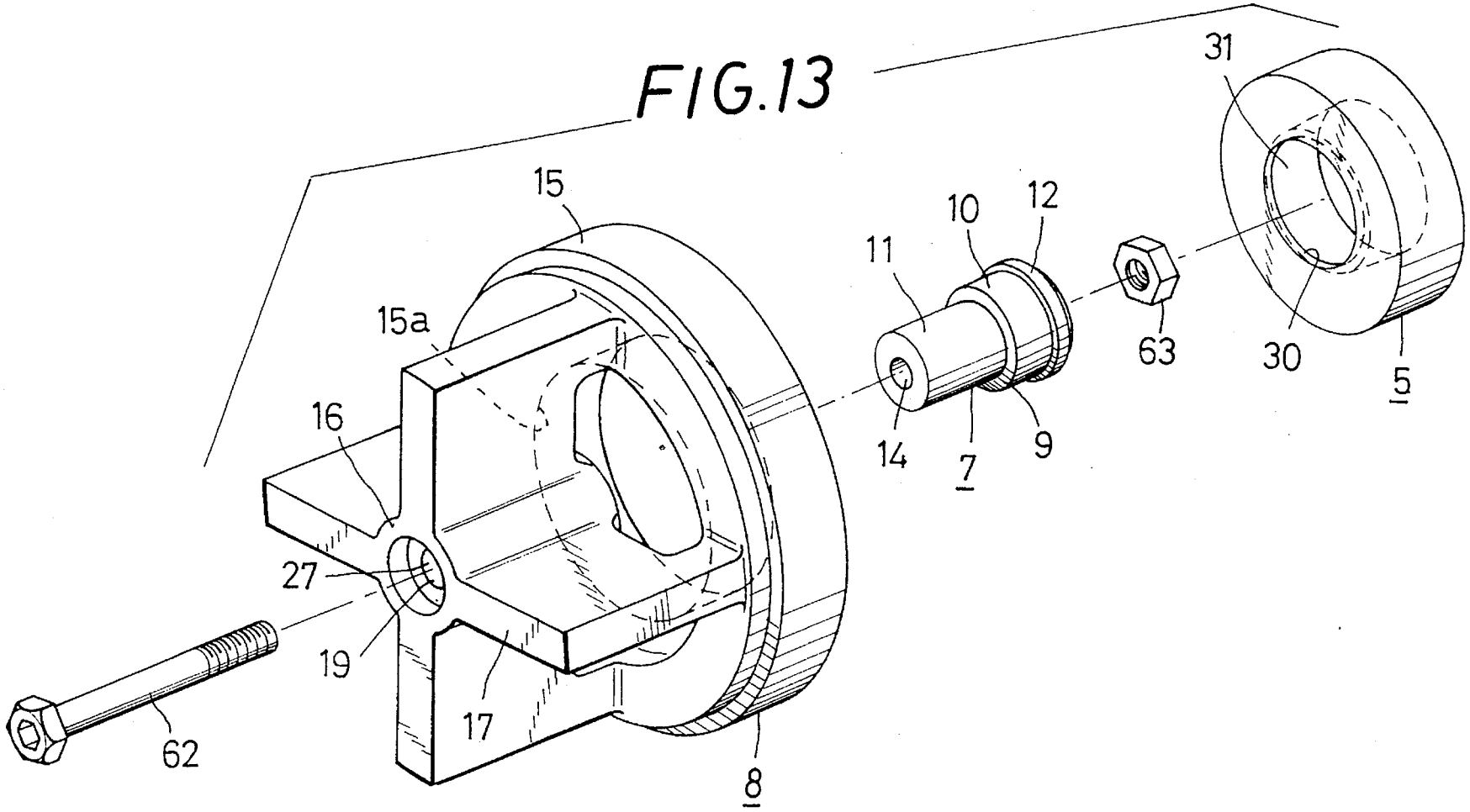
FIG. 13 is a perspective view of a die supporter, a core, a female member and other members separated one from another and included in the die assembly according to the third embodiment.
Figure 14:
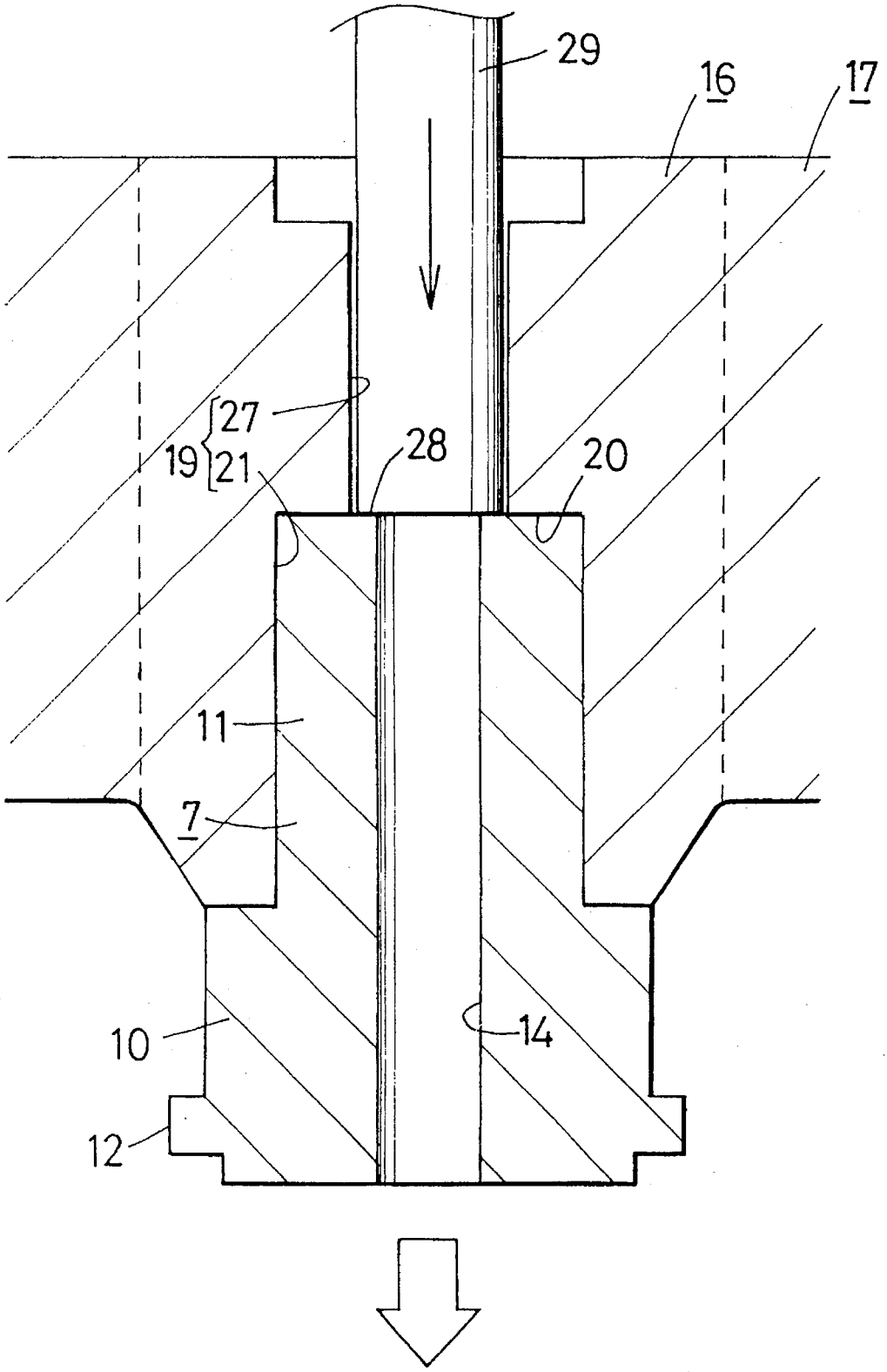
FIG. 14 shows a manner of dismounting the core from the male die, in the third embodiment.

A bolt-nut structure is employed as the retaining mechanism for preventing the core from slipping off, in a third embodiment shown in FIGS. 12–14. The bore 14 extends through the core 7 including the body 11, which body fits in the cylindrical recess 21 formed as a region of the axial bore 19. This axial bore 19 penetrates the core holder 16 formed as one portion of the die supporter 8. A leg of the bolt 62 is inserted forwards into the holder's bore 19 and the core's bore 14, and the nut 63 is fastened to a forwardly protruding threaded end of the leg so as to secure the core 7 in the holder 8.

Such a bolt-nut structure as the retaining mechanism is advantageous in that the bolt can adjustably be fastened to hold the core in place more surely and more inexpensively. The core 7 which has to be renewed can readily removed by using the punch or the like tool 29, as seen in FIG. 14. The other structural features of the third embodiment are the same as those employed in the first embodiment, and afford the same effects.

Figure 15:
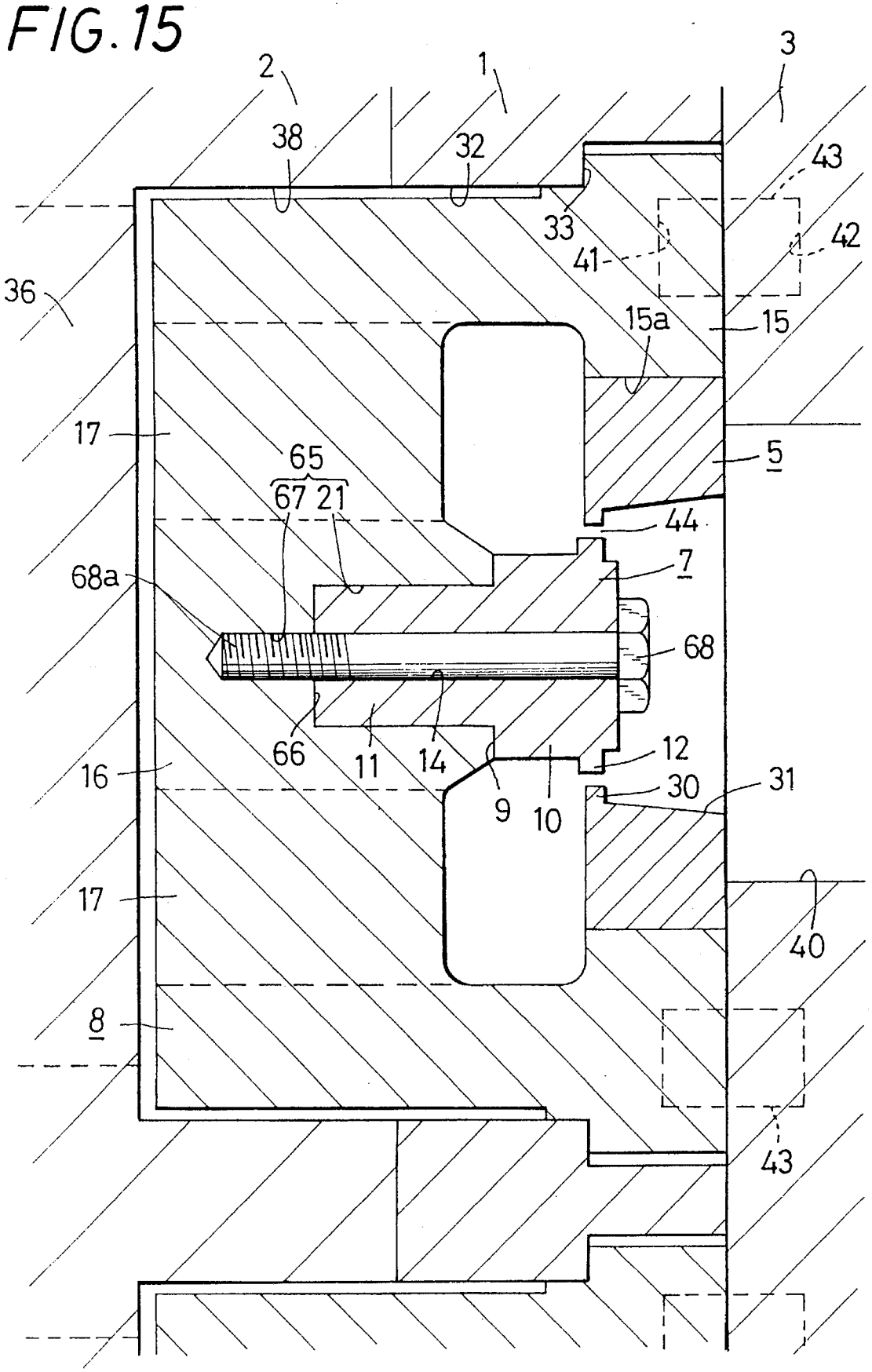
FIG. 15 is an enlarged cross section of a main part constituting a die assembly provided in a fourth embodiment.

A bolt is employed as the retaining member for preventing the core from slipping off, in a fourth embodiment shown in FIG. 15. A one-end opened cylindrical recess 65 is formed axially of core holder 16 in the die supporter 8. A threaded hole 67 extends inwards from a bottom of the recess 65, the bottom serving as the annular shoulder 66 similar to that in the first embodiment. The bore 14 extends through the core 7 including the body 11, which body fits in the cylindrical recess 21 formed in the core holder 16. A threaded end 68*a* of the bolt's leg is fastened into the threaded hole 67 of the core holder, to thereby hold the core in place similarly to the third embodiment. The other structural features of the fourth embodiment are the same as those employed in the first embodiment, and afford the same effects.

Figure 16:
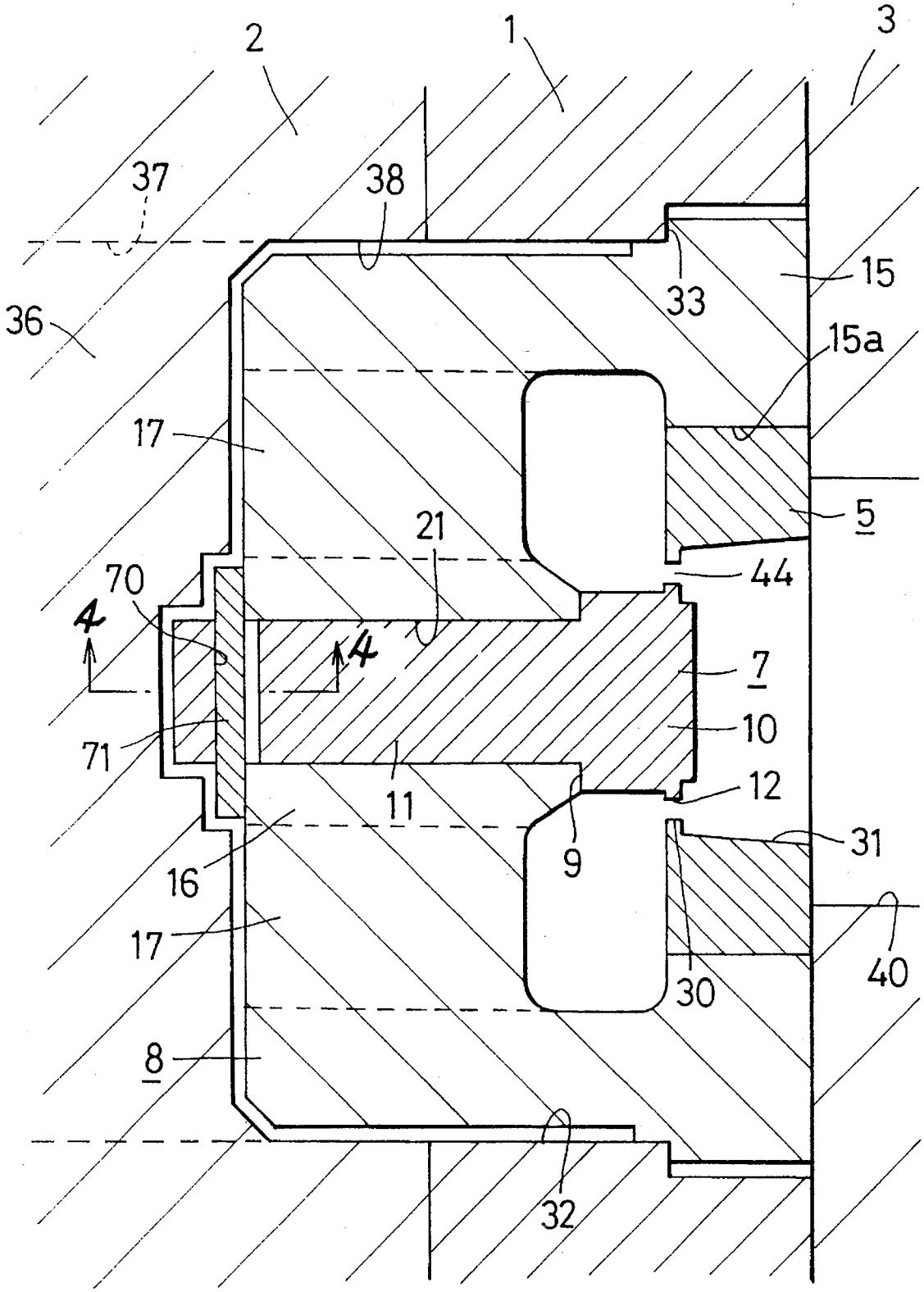
FIG. 16 is an enlarged cross section of a main part constituting a die assembly provided in a fifth embodiment.
Figure 17:
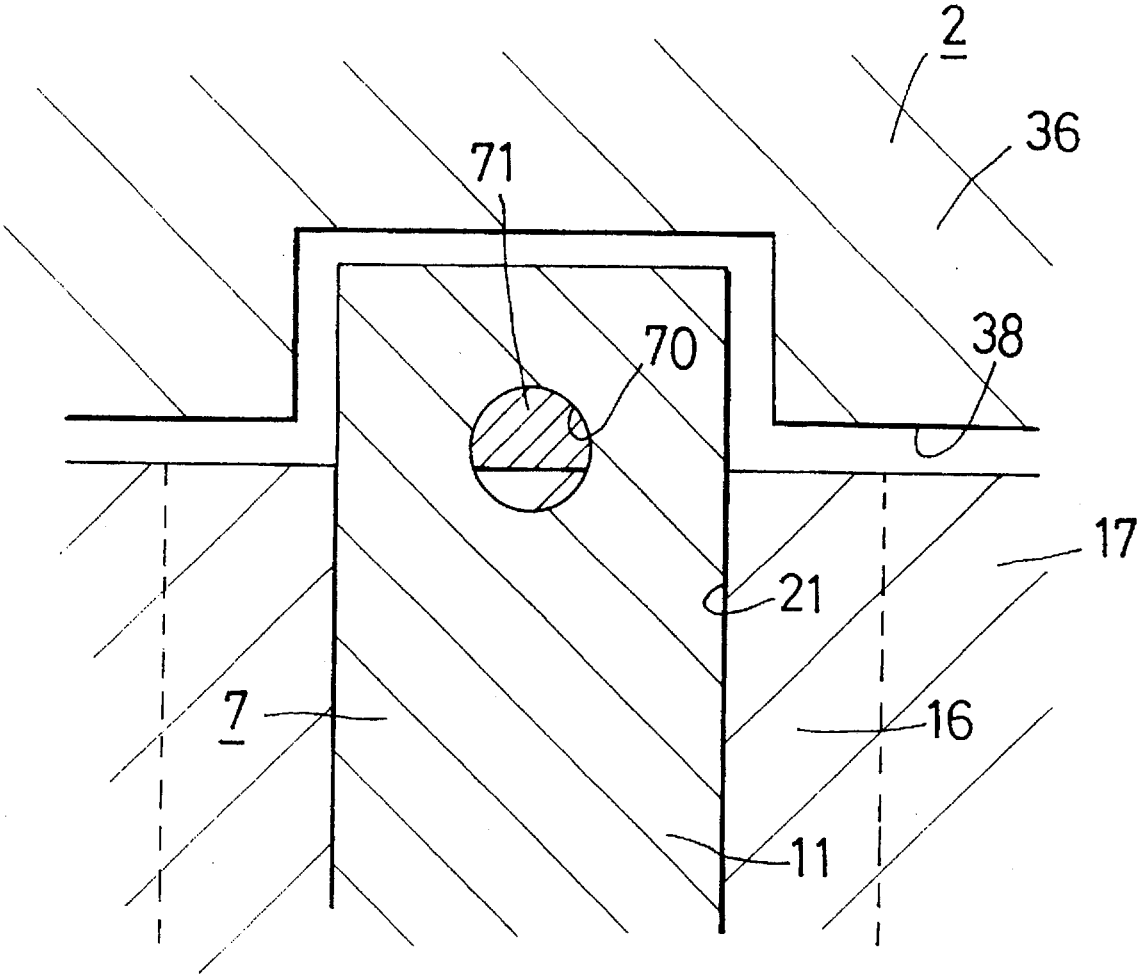
FIG. 17 is a cross section taken along the line 4—4 in FIG. 16.
Figure 18:
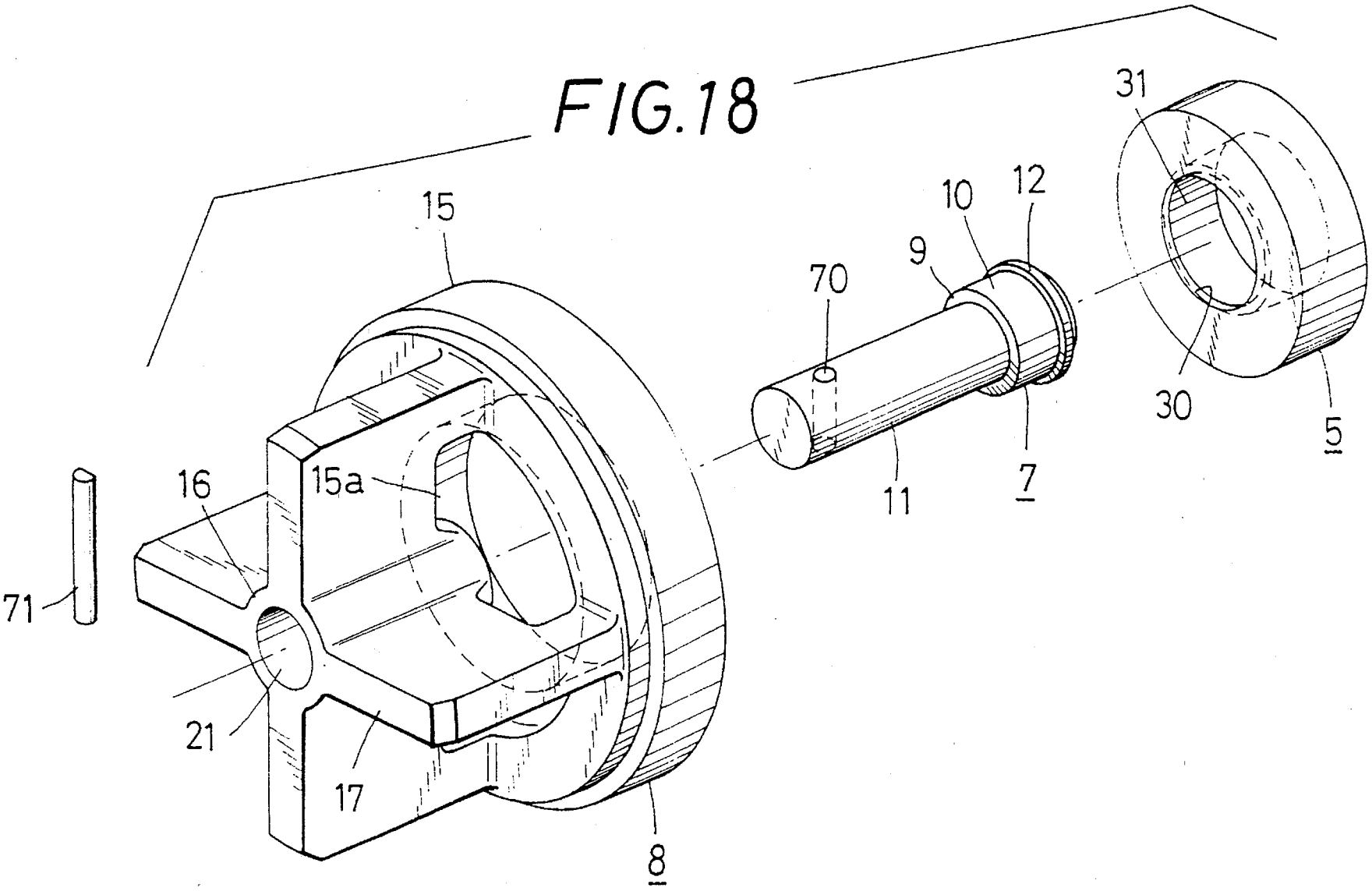
FIG. 18 is a perspective view of a die supporter, a core, a female member and another member separated one from another and included in the die assembly according to the fifth embodiment.

In a fifth embodiment shown in FIGS. 16–18, a pin is employed to provide the retaining mechanism for preventing the core from slipping off. The body 11 of the core 7 is longer than the core holder 16 in the die supporter 8. With the body 11 being inserted in the bore 21 penetrating said core holder, a rear end of said body 11 protrudes rearward from the die supporter. A transverse hole 70 penetrates the rear end of the core's body. The pin 71 is inserted in and through this hole, so that both the opposite ends of this pin 71 jut sideways to engage the rear face of the core holder 16.

Such a pin-hole structure as the retaining mechanism is advantageous in that, in order to surely and easily hold the core 7 in place, it is only necessary for the pin 71 to be simply inserted in the hole 71 of the body's end of core 7 which is previously fitted in the bore 21 of the supporter 8. Manufacture of this die assembly is easier and less expensive, since only the hole 70 need be formed through the core's body so as to mate the pin 71 prepared as a discrete member. The other structural features of the fifth embodiment are the same as those employed in the first embodiment, and afford the same effects.

Figure 19:
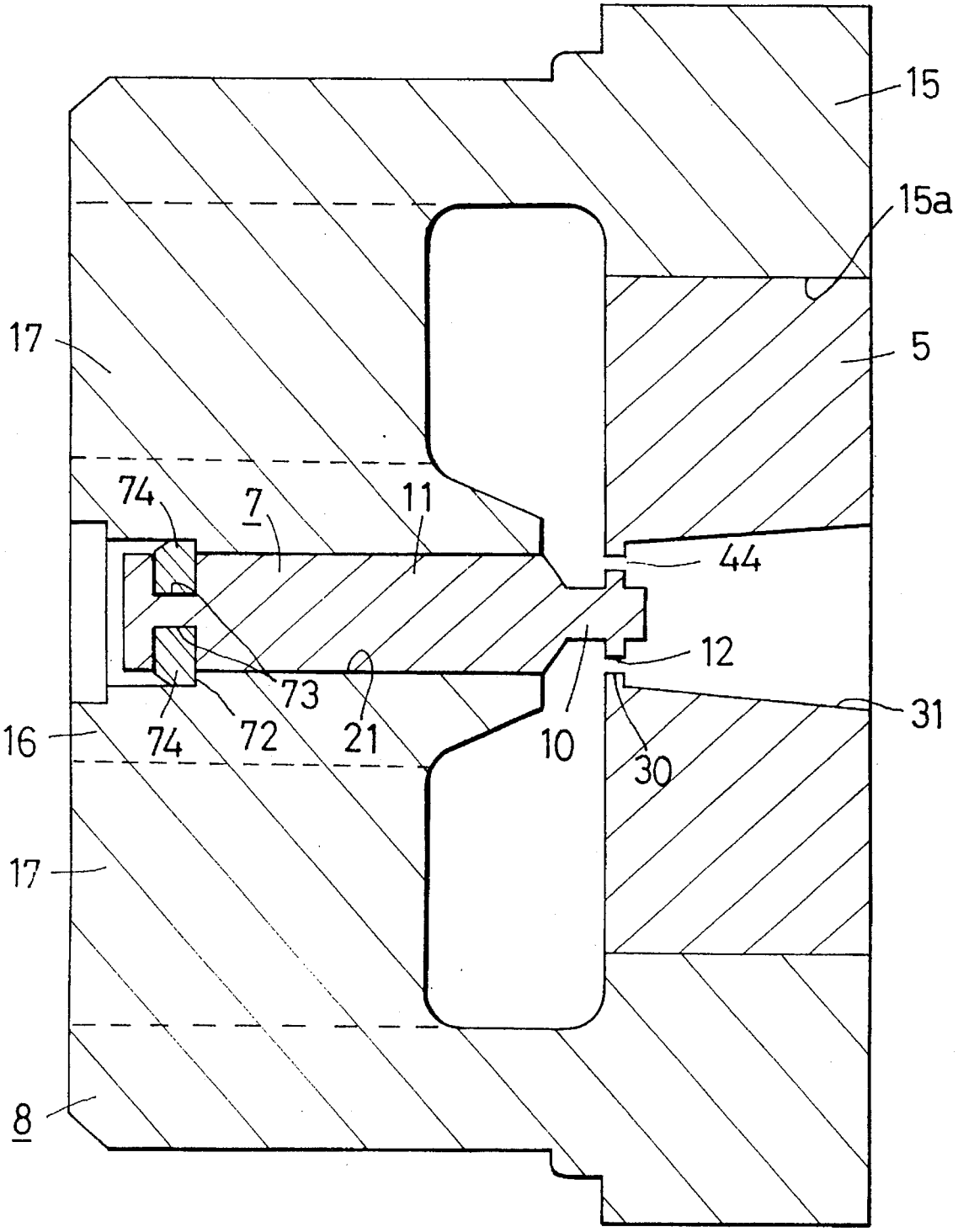
FIG. 19 is an enlarged cross section of a main part constituting a die assembly provided in a sixth embodiment.
Figure 20:
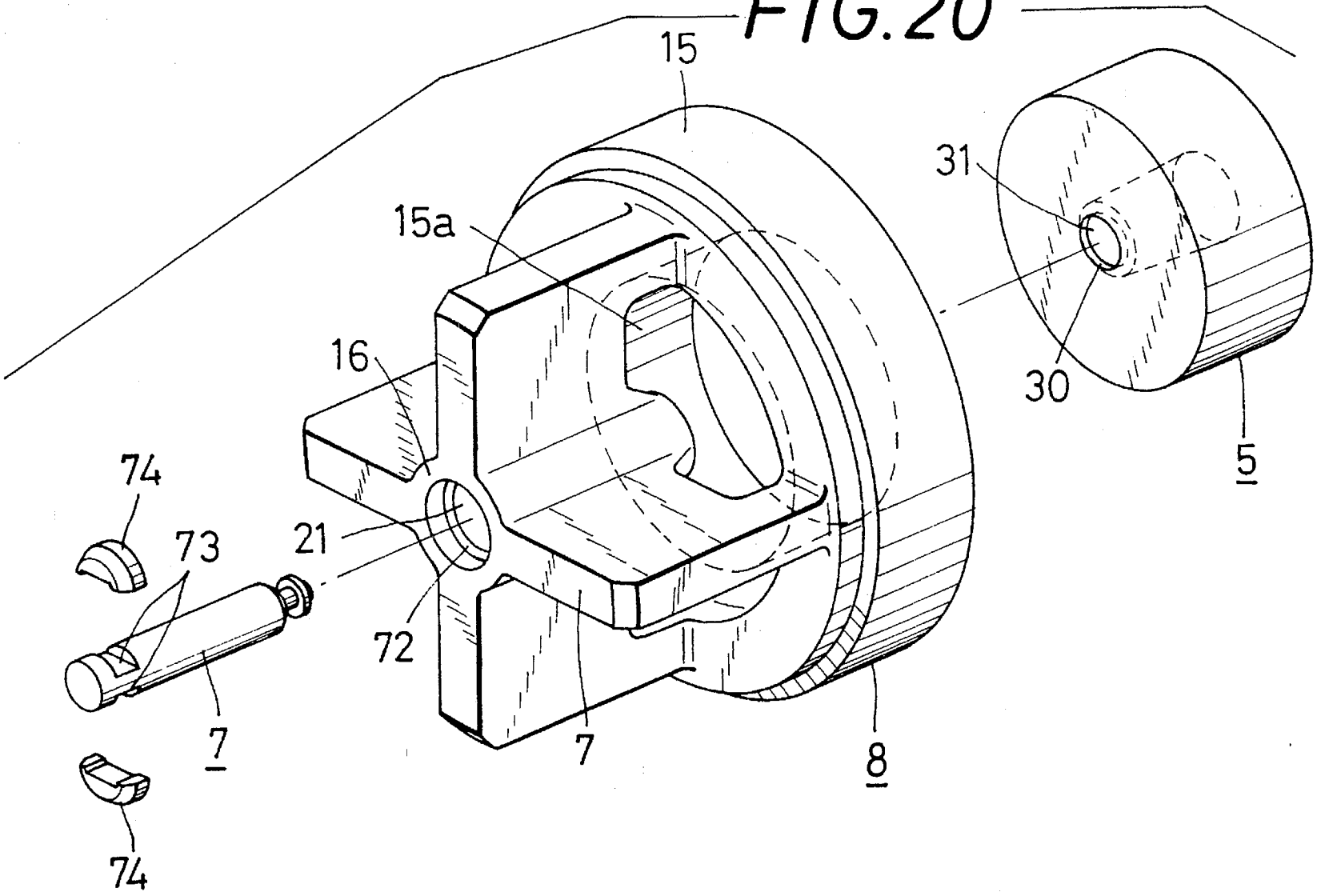
FIG. 20 is a perspective view of a die supporter, a core, a female member and other members separated one from another and included in the die assembly according to the sixth embodiment.

In a sixth embodiment shown in FIGS. 19 and 20, keys are employed to provide the mechanism for retaining the core. Two transverse grooves 73 are formed in opposite diagonal sides of a rear basal end of the core 7. The semicircular keys 74 fit in the grooves 73 such that an outer peripheral edge of each key bears against an annular shoulder 72. This shoulder is disposed between the cylindrical recess 21 for holding the core's body and another recess of a larger diameter and continuing rearward from the first mentioned recess 21. The core can thus be immovably held in place during the extrusion process, thanks to this mechanism comprising the keys and grooves. The other structural features of the sixth embodiment are the same as those employed in the first embodiment, and afford the same effects.

Figure 21:
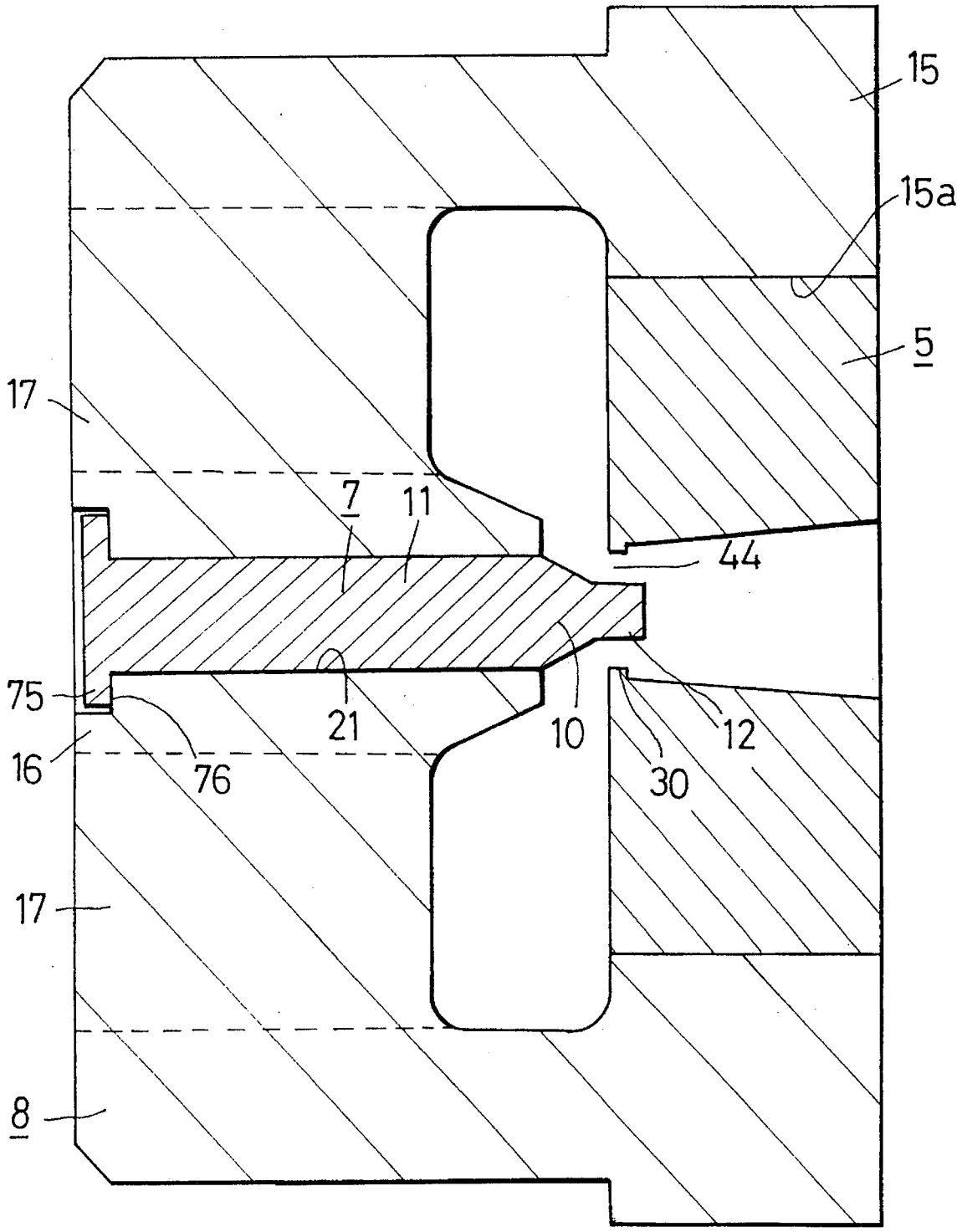
FIG. 21 is an enlarged cross section of a main part constituting a die assembly provided in a seventh embodiment.

In a seventh embodiment shown in FIG. 21, a flange 75 of a diameter larger than the core body is formed integral therewith. This flange is supported by an annular shoulder 76 formed at the rear end of the cylindrical recess 21, which recess penetrates the core holder 16 of the die supporter 8. This mechanism for retaining the core is similarly effective to surely hold it in place during the extrusion process.

Figure 22:
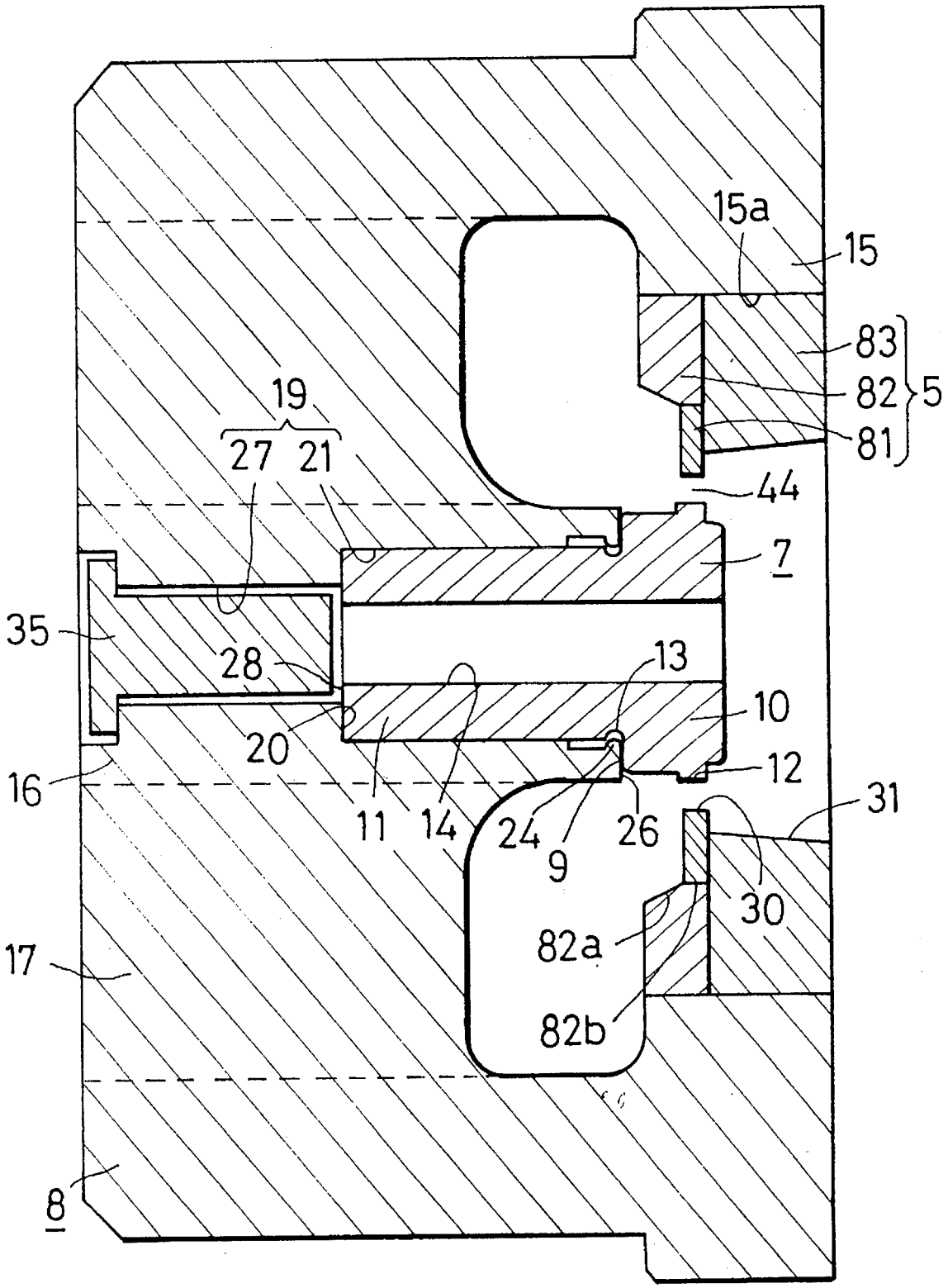
FIG. 22 is an enlarged cross section of a main part constituting a die assembly provided in a eighth embodiment.
Figure 23A:
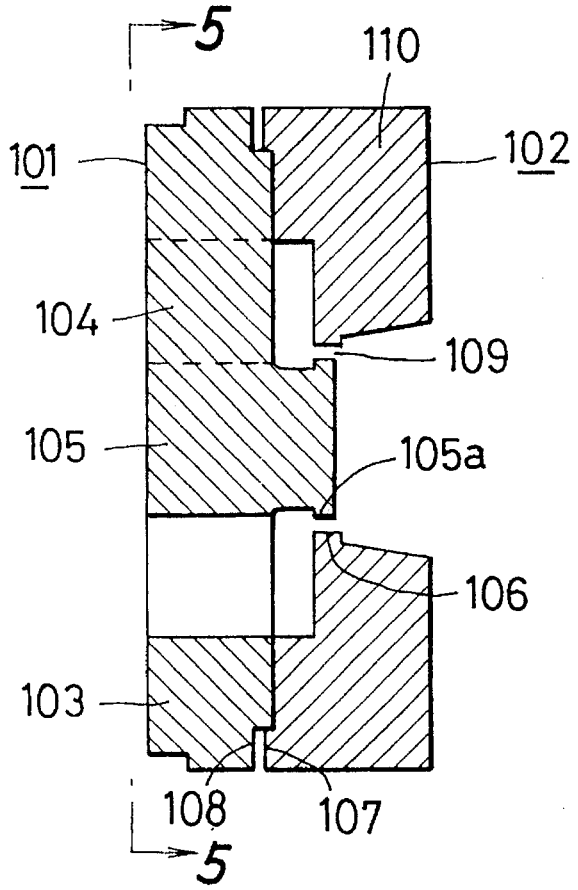
FIG.23A (PRIOR ART)
FIG. 23A is a cross section of a prior art die assembly.
Figure 23B:
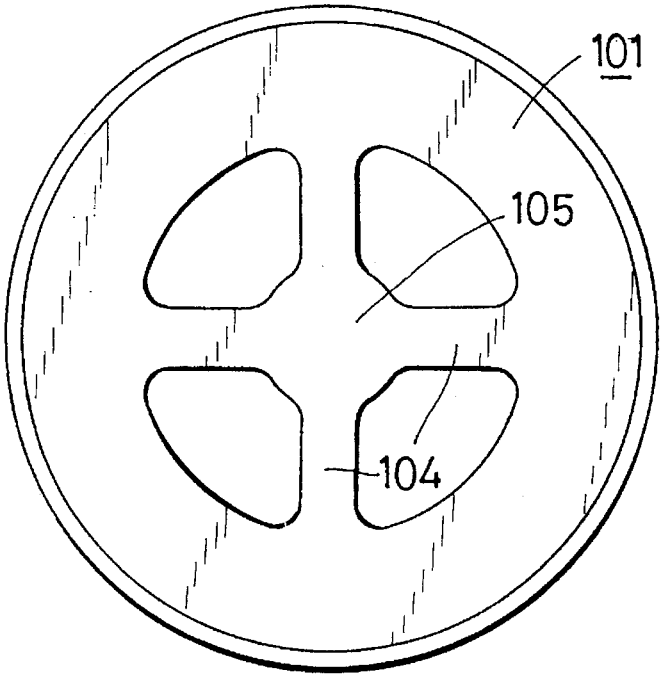
FIG.23B (PRIOR ART)
FIG. 23B is a side elevation of the prior art die assembly, seen from the line 5—5 in FIG. 23A.

FIG. 22 shows an eighth embodiment, in which the female member 5 is of a composite structure comprising a few parts so as to renew the female die in an inexpensive manner. The female member consists of a bearing piece 81, a ring 82 surrounding the bearing piece, and a back-up piece 83.

The bearing piece 81 is a plate through which the forming hole 30 is opened, and thus the thickness of this piece is substantially equal to the bearing length for the female die. An outer diameter of the bearing piece 81 is smaller than the diameter of the inner periphery 15*a* of the supporter's annular base 15.

The ring 82 for positioning the bearing piece 81 is in contact with the outer periphery thereof, and is thicker than said piece. The outer periphery of this ring 82, in turn, tightly engages with the inner periphery 15*a* of the annular base formed as the portion of the die supporter 8. A central opening of the ring 82 consists of a forward straight region 82*b* and a rearward tapered region 82*a*. The bearing piece 81 will be inserted in this ring 82 from the rearward region 82*a* thereof, so as to tightly fit in the forward region 82*b* having the same thickness as the bearing piece. Since the rearward region 82*a* is tapered to increase its diameter towards the interior of die supporter, the bearing piece 81 can smoothly be guided into the forward region 82*b*.

The back-up piece 83 for supporting the bearing piece 81 and ring 82 at forward faces thereof has an outer diameter such that the outer periphery of this back-up piece be in close contact with the inner periphery 15*a* of the annular base 15. The overall thickness of the back-up piece 83 and the ring 82 is equal to that of the inner periphery 15*a* of the supporter's annular base 15. A round and tapered relief hole 31 is formed through and axially of the back-up piece. The diameter of a rear opening of this relief hole 31 is smaller than the outer diameter of the bearing piece 81, but slightly larger than the forming hole 30 thereof. Thus, the rear face of back-up piece 83 is adapted to support not only the ring 82 but also the bearing piece 81.

This female member 5 will be incorporated in the die supporter 8 in such a manner that the bearing piece 81 is fitted first in the straight region 82*b* of the ring 82, and this ring will then be shrinkage-fitted together with the back-up piece 83 in the inner periphery 15*a* of the annular base 15. The other structural features of the eighth embodiment are the same as those employed in the first embodiment.

In summary, the male die in each embodiment of the present invention consists of the male die supporter and the core separable therefrom. When the male die is abraded and has to be renewed, only the core need be replaced with a new one, reusing the supporter to lower the maintenance cost.

Since the core is shrinkage-fitted in the cylindrical recess formed in the core holder of the supporter, the latter can exactly hold the core and enhance accuracy in alignment thereof with the bearing edge. Consequently, high quality hollow articles free of any uneven wall thickness are now produced.

Since the female member tightly fits in the annular base of the male die supporter, the position of said core relative to the forming hole of said member is regulated by the base's inner periphery located near the forming slit. Thanks to this feature, any forward pressure imparted to and tending to deform the parts of this die assembly will not cause any intolerable displacement of the core relative to said forming hole. Thus, the hollow articles are protected from the unevenness in their wall thickness.

Further, the female member is shrinkage-fitted to the annular base of the male die supporter so that a high accuracy is ensured to the alignment thereof with said member and thus to the alignment of the forming hole with the core. Therefore, the extruded hollow articles are free from the unevenness in their wall thickness.

As described above, the annular base fittable on the female member is integral with the bridges and also with the core holder which has the cylindrical recess for holding the core. Therefore, the core can precisely be aligned with the female member, also avoiding any uneven wall thickness in extruded articles.

The retaining mechanism overcoming the force which the material being extruded imparts to the core is effective to protect it from slipping off during the extrusion process. In detail, the shrinkage-fitting of the core contributes mainly to the alignment thereof with the female member, but possibly not so effective to prevent the core from slipping off. The retaining mechanism is therefore designed to compensate the possibly insufficient retaining effect of the shrinkage-fitting structure.

The retaining mechanism for the core, which may possibly be of the composite structure, relies on the pressure of the extruded material which causes the described members or portions to engage with each other, whereby they are protected from disengaging from each other.

Such an effect of retaining the core will automatically appear by the pressure of extruded material, after simply placing the core in the cylindrical recess or bore formed in or through the core holder integral with the male die supporter. Therefore, the die assembly proposed herein can be manufactured easily.

In detail, the retaining mechanism for the core can be provided easily and inexpensively by forming the slits in the peripheral wall of cylindrical lug and by machining the inner periphery thereof and the core's outer periphery.

What is claimed is:

1. A die assembly for extruding hollow articles, the assembly comprising:

at least one core having a bearing tip to form a hollow space through a hollow article extruded by the die assembly;

at least one male die supporter composed of an annular base, a core holder and bridges rigidly connecting the base to the core holder;

a cylindrical recess formed in the core holder so as to open forward in the direction of the extrusion;

at least one female member having a bearing hole to form a periphery of the hollow article; and a core retaining means to prevent the core from slipping off forward in the direction of extrusion, including:

a cylindrical lug protruding forward in the direction of extrusion beyond the bridges;

slits formed in the cylindrical lug and longitudinally thereof so that sections each defined between the adjacent slits are capable of deforming radially and inwardly of the lug; and a latching mechanism including a protrusion or recess formed integral with an inner periphery of the cylindrical lug and a recess or protrusion formed integral with an outer periphery of the core, such that a pressure of the material being extruded acts on an outer periphery of the lug so that the protrusion or recess thereof is forced radially and inwardly to engage with the recess or protrusion of the core, thereby preventing the core from slipping off the direction of extrusion, wherein a body of the core is shrinkage-fitted in the cylindrical recess of the core holder so as to be integral with the die supporter, and the female member is shrinkage-fitted in the annular base of the die supporter so as to be integral therewith.

2. A die assembly as defined in claim 1, wherein the recess of the core is an annular groove engageable with the protrusion which also is annular and jutting from the inner and foremost peripheral edge of the cylindrical lug.

3. A die assembly for extruding hollow articles, the assembly comprising:

at least one core having a bearing tip to form a hollow space through a hollow article extruded by the die assembly;

at least one male die supporter composed of an annular base, a core holder and bridges rigidly connecting the base to the core holder;

a cylindrical recess formed in the core holder so as to open forward in the direction of extrusion;

at least one female member having a bearing hole to form a periphery of the hollow article; and a core retaining means to prevent the core from slipping off forward in the direction of extrusion, wherein a body of the core is shrinkage-fitted in the cylindrical recess of the core holder so as to be integral with the die supporter, and the female member is shrinkage-fitted in the annular base of the die supporter so as to be integral therewith, and an axial bore penetrating the core holder in the direction of extrusion such that an annular shoulder is formed perpendicular to said direction and intermediate front and rear ends of said bore for supporting the rear end of the core, said axial bore containing a larger-diameter region formed between the shoulder and the front end of the bore to receive the body of said core, and a smaller-diameter region formed between the shoulder and the rear end of the bore, such that a portion of the rear end surface of the core is exposed to said smaller-diameter region so that the exposed surface is capable of being struck with a punch, or the like, tool.

4. A die assembly for extruding hollow articles, the assembly comprising:

a core having a bearing tip to form a hollow space through a hollow article extruding by the die assembly;

a core holder integral with bridges and having a cylindrical recess formed in the core holder so as to open forward in the direction of extrusion;

a cylindrical lug protruding forward in said direction beyond the bridges;

slits formed in the cylindrical lug and longitudinally thereof so that sections each defined between the adjacent slits is capable of deforming radially and inwardly of the lug; and a core retaining means including a protrusion or recess formed integral with or in an inner periphery of the cylindrical lug and a recess or protrusion formed in or integral with an outer periphery of the core, such that a pressure of a material being extruded acts on an outer periphery of the lug so that the protrusion or recess thereof is forced radially and inwardly to engage with the recess or protrusion of the core, thereby preventing the core from slipping off in the direction of extrusion.

5. A die assembly as defined in claim 4, wherein the recess of the core is an annular groove engageable with the protrusion which also is annular and jutting from the inner and foremost peripheral edge of the cylindrical lug.

6. A die assembly as defined in claim 4, wherein a basal end portion fits in the cylindrical recess formed in the core holder of the male die supporter, so that the core is shrinkage-fitted in the core holder.

7. A die assembly as defined in claim 4, wherein an axial bore penetrates the core holder in the direction of extrusion such that an annular shoulder is formed perpendicular to said direction and intermediate front and rear ends of said bore, the shoulder supporting the rear end of the core, a larger-diameter region formed between the shoulder and the front end of the bore receives the body portion of said core, and a smaller-diameter region is formed between the shoulder and the rear end of the bore, such that a portion of the rear end surface of the core is exposed to said smaller-diameter region so that the exposed surface is capable of being struck with a punch or the like tool.

* * * * *